US006734626B2

(12) United States Patent
Yoshioka et al.

(10) Patent No.: US 6,734,626 B2
(45) Date of Patent: May 11, 2004

(54) PLASMA DISPLAY PANEL AND FABRICATION METHOD THEREOF

(75) Inventors: Toshihiro Yoshioka, Tokyo (JP); Akira Miyakoshi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/910,792

(22) Filed: Jul. 24, 2001

(65) Prior Publication Data

US 2002/0008475 A1 Jan. 24, 2002

(30) Foreign Application Priority Data

Jul. 24, 2000 (JP) ..... 2000-222181

(51) Int. Cl.[7] ..... H01J 17/49
(52) U.S. Cl. ..... 313/585; 313/485; 313/495
(58) Field of Search ..... 313/495, 582, 313/584, 586, 585, 587, 485, 621

(56) References Cited

U.S. PATENT DOCUMENTS 5,086,297 A * 2/1992 Miyake et al. ..... 345/65
5,210,468 A * 5/1993 Yoshioka ..... 315/169.4
5,428,263 A * 6/1995 Nagano ..... 313/585
5,541,479 A * 7/1996 Nagakubo ..... 313/586
5,661,500 A * 8/1997 Shinoda et al. ..... 345/60
5,818,168 A * 10/1998 Ushifusa et al. ..... 313/582
5,883,462 A * 3/1999 Ushifusa et al. ..... 313/292
5,952,782 A * 9/1999 Nanto et al. ..... 313/584
6,084,349 A * 7/2000 Ueoka et al. ..... 313/587

FOREIGN PATENT DOCUMENTS

| | | |
|---|---|---|
| JP | A 6-139923 | 5/1994 |
| JP | A 7-85798 | 3/1995 |
| JP | 2000-113827 | 4/2000 |

* cited by examiner

*Primary Examiner*—Sandra O'Shea
*Assistant Examiner*—Dalei Dong
(74) *Attorney, Agent, or Firm*—Young & Thompson

(57) ABSTRACT

In order to improve the light emitting efficiency of a surface-discharge type color PDP, a sustaining electrode is divided into a plurality of electrodes formed in respective different layers. Lower electrodes 121 and upper electrodes 122 in different layers are formed as electrode pairs, an upper dielectric layer 14 is formed on the upper electrodes 122 in an upper layer to make a dielectric layer on the surface-discharge electrode pair thin to thereby maintain the discharge sustaining voltage low and obtain high light emitting efficiency.

20 Claims, 22 Drawing Sheets

PLASMA DISPLAY PANEL AND FABRICATION METHOD THEREOF

BACKGROUND OF THE INVENTION

1. Field of the Invention

The present invention relates to a plasma display panel and, particularly, to a structure of a surface-discharge type color plasma display panel having reduced power consumption and a fabrication method of the same color plasma display panel.

2. Description of the Prior Art

As a flat display panel whose display area can be increased easily, attention has been paid to a plasma display panel (PDP). Particularly, the color PDP has been used in a personal computer, a display of workstation and a wall television, etc. A surface-discharge type color PDP among such color PDPs is constructed with a first glass substrate equipped with electrode pairs, which are covered by a dielectric layer and each of which includes a pair of electrodes opposing mutually in a plane to form a discharge space therebetween, and a second glass substrate arranged in an opposing relation to the first glass substrate through discharge gas. Visible display is realized by applying a voltage between the electrodes of each electrode pair to generate discharge therebetween and irradiating a fluorescent member formed on an inner surface of the PDP with ultraviolet ray generated by the discharge.

A portion of a conventional surface-discharge type color PDP, which corresponds to one discharge cell thereof, is shown in FIGS. 20A, 20B and 20C, which are a plan view of the discharge cell of the conventional surface-discharge type PDP, a cross section taken along a line A–A' in FIG. 20A and a cross section taken along a line C–C' in FIG. 20A, respectively, As shown in FIGS. 20A, 20B and 20C, sustaining electrodes 712, which become electrode pairs, are formed on one and the same surface of the first glass substrate 711 and are covered by a dielectric layer 724 of a low melting point glass material and a protective film 715 formed of magnesium oxide (MgO), etc.

Thickness of the dielectric layer 724 formed on the sustaining electrodes 712 is usually uniform substantially. When the dielectric layer 724 is made thick in order to improve the light emitting efficiency of the PDP, the discharge sustaining voltage is increased. On the contrary, when the dielectric layer 724 is made thin in order to restrict the discharge sustaining voltage, the light emitting efficiency is lowered.

In order to solve such contradiction, JP 2000-113827A propose two examples of a structure of a surface-discharge type color PDP, which will be described briefly with reference to FIGS. 21A and 21B.

As shown in FIG. 21A or 21B, thickness of a dielectric layers 824 or a dielectric layer 924 is changed within a discharge cell such that a portion of the dielectric layer 824 or 924 in a location opposing to a sustaining electrode 812 or 912 becomes thinnest.

However, it is generally difficult to control the thickness of the dielectric layer 824 or the dielectric layer 924 throughout the panel. Since a variation of thickness of the dielectric layer affects discharge characteristics of the panel, it is difficult to obtain a PDP having desired display characteristics.

SUMMARY OF THE INVENTION

An object of the present invention is to provide a surface-discharge type color PDP having desired display characteristics.

Another object of the present invention is to provide a surface-discharge type color PDP capable of improving light emitting efficiency and realizing a reduction of power consumption.

Another object of the present invention is to provide a method for fabricating a surface-discharge type color PDP.

The present invention is applicable to a surface-discharge type color PDP comprises a first substrate having a plurality of electrode pairs covered by a dielectric layer, a second substrate arranged in an opposing relation to the first substrate with a gap and discharge gas filling the gap between the first substrate and the second substrate in which discharge is generated in the discharge gas by applying a voltage between the electrode pair in each discharge cell. The present invention has a basic structure in which at least one of electrodes of each electrode pair is divided in a thickness direction of the dielectric layer such that a lower electrode and an upper electrode are formed, which are electrically connected to each other to make the upper and lower electrodes equipotential.

The above mentioned basic construction of the surface-discharge type color PDP of the present invention is expansive in various manners to be described below.

In a first aspect of the surface-discharge type color PDP according to the present invention, both the electrodes of the sustaining electrode pair covered by the dielectric layer are spatially separated in the thickness direction of the dielectric layer. The spatially separated sustaining electrodes are electrically connected each other.

On the first substrate on which the discharge sustaining electrode pairs are formed, one electrodes and the other electrodes of the electrode pairs extend in parallel to each other and the plurality of the electrode pairs extend in parallel with a space therebetween.

In such surface-discharge type PDP, each of the electrode of each electrode pair includes an upper electrode and a lower electrode, the upper electrode of one electrode of the electrode pair is provided in a plurality of different layers and the upper electrodes of the other electrode of the electrode pair are provided in the same number of different layers and corresponding ones of the electrode layers of the upper electrodes are in the same position in the thickness direction of the dielectric layer. In such construction, the one of the opposing upper electrodes and the other of the opposing upper electrodes are formed symmetrically about a center of a first sustain gap between one of the lower electrodes of each electrode pair and the other lower electrode.

Furthermore, a second sustain gap may be provided between one of the upper electrodes and the other upper electrode, which are mutually opposing with a gap therebetween, which gap is the smallest among gaps between the upper electrodes of the electrode pair, and the second sustain gap is substantially coincident with the first sustain gap. Alternatively, a second sustain gap is provided between one of the upper electrodes and the other upper electrode, which are mutually opposing with a gap therebetween, which gap is the smallest among gaps between the upper electrodes of the electrode pair, and one of the first sustain gap and the second sustain gap is within the other sustain gap.

When the upper electrodes of the electrodes constituting the electrode pair are arranged in a single layer and the sustaining second region is within the first sustain gap, the upper electrodes are within the first sustain gap.

When the upper electrodes of the one and the other electrodes of the electrode pair are arranged in a single layer, the second sustain gap may be coincident with the first sustain gap or the first sustain gap is within the second sustain gap.

Alternatively, a center of said first sustain gap may be deviated from a center of said second sustain gap.

Alternatively, when the upper electrodes of the electrodes constituting the electrode pair are in a single layer, respectively, either one of the upper electrodes may be within the first sustain gap.

The surface-discharge type color PDP of the present invention may be constructed such that each of the electrodes of each electrode pair includes the lower electrode and the upper electrode and at least one divided electrode having a potential equal to the potential of one of the upper electrodes is provided on a side of the one upper electrode corresponding to at least one of the lower electrodes in a plane, which is the same as a plane of the one upper electrode, remote from the other lower electrode.

In the above-mentioned PDP, a width of the upper electrode is a half of a width of the lower electrode or less. Alternatively, the width of the upper electrode may be one-fifth the width of the lower electrode or less.

The PDP of the present invention may further comprise a connecting wiring for electrically connecting the upper electrode to the lower electrode to make the upper and lower electrodes equipotential and a low resistance wiring for leading the upper electrode together with the lower electrode externally. The PDP having such construction may further comprise partition walls formed on the second substrate extending in parallel in a direction orthogonal to the electrode pairs formed on the first substrate, wherein the first substrate includes discharge cell regions uniformly partitioned by the partition walls and regions for separating the plurality of the electrode pairs and the connecting wiring is formed in a region of each the discharge cell region except the second sustain gap between the upper electrodes corresponding to the electrode pair. The connecting wiring may be formed in regions opposing to the partition walls.

Preferably, the low resistance wiring extend in parallel to the electrode pairs on the first substrate along a line separated from the electrode pairs. The upper electrodes are formed of an electrically conductive material containing a metal or metal particles as a main constituent.

The low resistance wiring may be formed of the same material as that of the upper electrodes. Moreover, the upper electrode may be thinner than the lower electrode as well as the low resistance wiring.

The low resistance wiring may be formed of a material different from the material of the upper electrode.

In the surface-discharge type PDP in which the upper electrode is connected to the lower electrode by the connecting wiring to make the upper and lower electrodes equipotential and the upper electrode is connected externally together with the lower electrode by the low resistance wiring, the low resistance wiring may be formed either on the substrate on which the lower electrodes are formed or in a level of the upper electrode in a thickness direction of the dielectric layer.

The low resistance wiring may be formed on the substrate on which the lower electrodes are formed and in a level of the upper electrode in a thickness direction of the dielectric layer. The low resistance wiring and the connecting wiring may be formed simultaneously.

In the PDP of the present invention, the upper electrode may be formed in a single layer and the dielectric layer may include a first dielectric layer deposited on the substrate and underlying the upper electrodes and a second dielectric layer covering the substrate having the first dielectric layer. In this PDP, the upper electrodes may constitute a single layer upper electrode pair corresponding to the electrode pair and the dielectric layer is formed below the second sustain gap between the upper electrode pair such that the dielectric layer contains the second sustain gap.

According to the present invention, the discharge gas contains at least one of xenon (Xe), krypton (Kr), argon (Ar) and nitrogen ($N_2$) as exciting gas for generating ultraviolet light for exciting a fluorescent member and a partial pressure of the exciting gas is 100 hPa or higher when the exciting gas contains one of Xe, Kr, Ar and $N_2$.

Furthermore, a method for fabricating a PDP, according to the present invention comprises the steps of forming a first electrode pair constituting lower electrodes on a surface of a first substrate, forming a first dielectric layer covering at least a first sustain gap between the first electrode pair, forming a second electrode pair constituting upper electrodes on the first dielectric layer, depositing a second dielectric layer covering the first substrate including the first dielectric layer, arranging the second substrate in an opposing relation to the first substrate with a gap therebetween and filling the gap with discharge gas.

In such method for fabricating a PDP, the step of forming the first dielectric layer may be performed by patterning the first dielectric layer such that the first dielectric layer covers at least the first sustain gap.

The step of forming the first dielectric layer covering at least the first sustain gap between the first electrode pair may be performed by screen printing.

The first and second dielectric layers are formed of glass materials and the softening point of the glass material forming the second dielectric layer is lower than that of the glass material of the first dielectric layer.

The method for fabricating the PDP may further comprise, between the step of forming the first electrode pair, which becomes the lower electrode, on the surface of the substrate and the step of forming the second electrode pair on the first dielectric layer, which becomes the upper electrodes, the step of forming a first electrode wiring for reducing a resistance of a connecting wiring of the first electrodes.

The method for fabricating the PDP may further comprise, after the step of forming the second electrode constituting the upper electrode on the first dielectric layer, the step of forming a second electrode wiring for reducing a resistance of a lead wiring of the second electrodes.

The fabrication method may further include the step of forming a connecting wiring for connecting the second electrode to the first electrode corresponding to the second electrode after the step of forming the second electrode on the first dielectric layer.

This method may further include, after the step of forming the second electrode on the first dielectric layer, the step of simultaneously forming the connecting wiring for connecting the second electrode to the first electrode corresponding to the second electrode and a common electrode wiring for reducing a resistance of lead wiring of the first electrode and the second electrode.

The step of forming the second electrode on the first dielectric layer is performed by forming connecting wiring for connecting the second electrode to a first electrode corresponding to the second electrode and a common wiring for reducing a resistance of lead wiring of the first electrode and said second electrode, simultaneously with the formation of said second electrode.

The connecting wiring may be formed of a metal or metal particles. When the upper electrode takes in the form of a transparent conductive film, the connecting wiring may be formed of the same material as that of the upper electrode.

DETAILED DESCRIPTION OF THE PREFERRED EMBODIMENTS

Figure 1A:
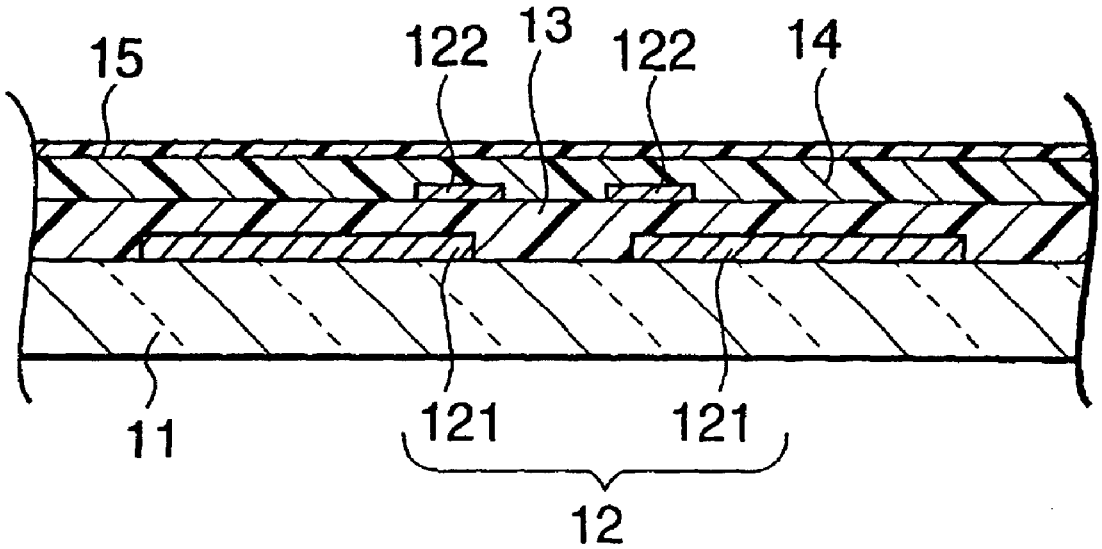
FIGS. 1A and 1B are cross sections of embodiments of electrode pairs and dielectric layers according to the present invention.

Before describing the present invention in detail, embodiments of electrode pairs and dielectric layers of a PDP according to the present invention will be described with reference to the drawings.

As mentioned previously, FIGS. 20A, 20B and 20C are the plan view of a discharge cell of a general surface-discharge type PDP, respectively, and FIGS. 1 to 5 show a construction of a first glass substrate corresponding to a first glass substrate 711 opposing to a second substrate 721 having partition walls 725 shown in FIGS. 20A to 20C and are cross sections of ten embodiments of the electrode pairs and the dielectric layer according to the present invention.

The structure thereof will be described briefly with reference to FIG. 1A.

Lower electrodes 121 formed of a transparent, electrically conductive material such as Indium-Tin-Oxide (ITO) containing indium oxide or tin oxide as a main constituent are formed on a first glass substrate 11 as a lower electrode pair 12.

Thereafter, a lower dielectric layer 13 containing a low melting point glass as a main constituent is formed to cover the lower electrodes 121 and, further, upper electrodes 122 of a transparent, electrically conductive material such as the above mentioned ITO are formed on the lower dielectric layer 13 correspondingly in position to the lower electrodes 121.

Then, an upper dielectric layer 14 containing a low melting point glass as a main constituent is formed on the lower electrodes 121 and the upper electrodes 122 such that a surface of a protective film 15 formed of such as MgO, which is exposed to a discharge space, becomes substantially flat.

With this formation of the dielectric films, thickness of the upper dielectric layer 14 on the upper electrodes 122 is smaller than that of the dielectric layer on the lower electrodes 121, which is a sum of thickness of the lower dielectric layer 13 and the upper dielectric layer 14.

Figure 4A:
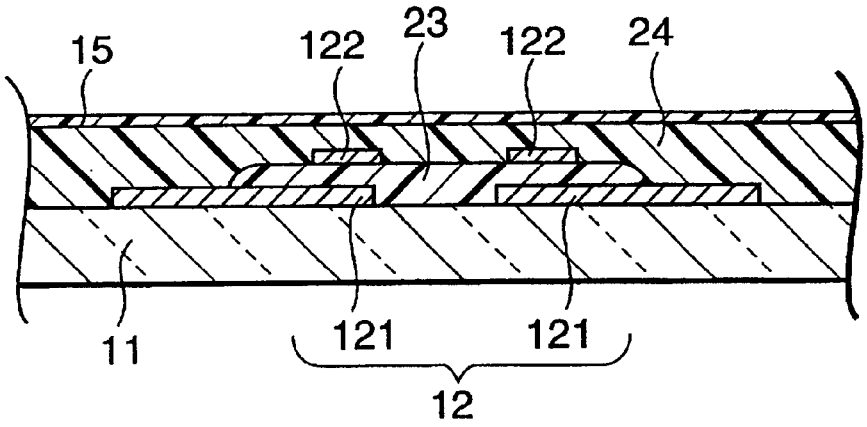
FIGS. 4A, 4B and 4C are cross sections of embodiments of electrode pairs and dielectric layers according to the present invention.
Figure 4B:
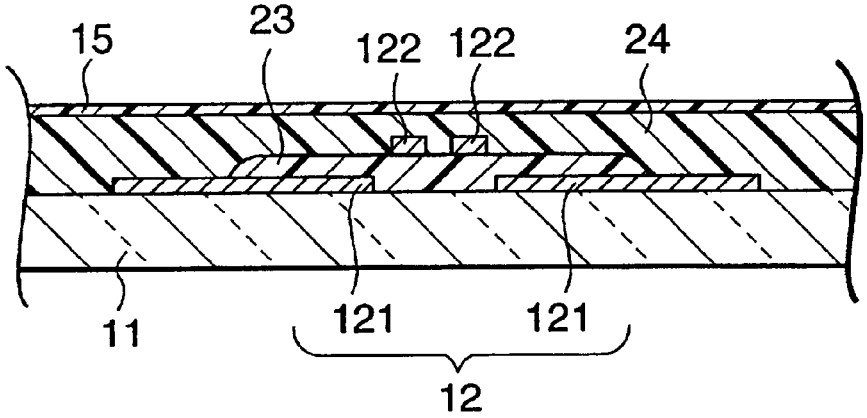
Figure 4C:
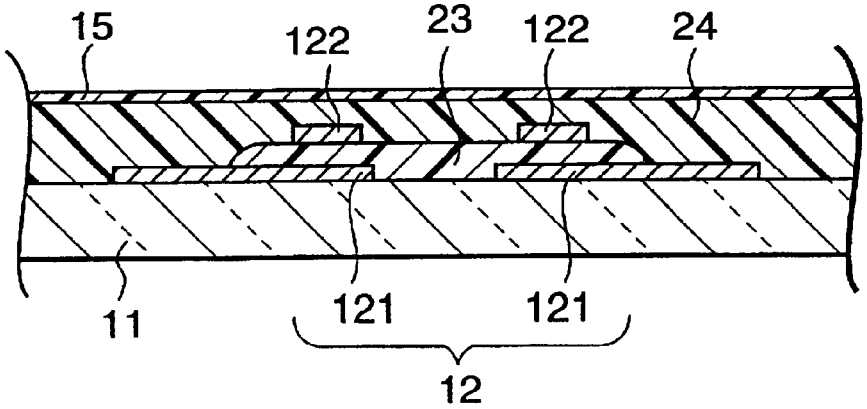

In each of FIGS. 1A, 1B and 2B and FIGS. 3A, 3B and 4B, an area is provided between the upper electrodes 122 in a sustain gap defined between inner ends of the lower electrodes 121 of the lower electrode pair 12. In FIGS. 2A and 4A, the sustain gap between the lower electrodes of the lower electrode pair 12 is coincident with the sustain gap between the upper electrodes 122. In FIGS. 2C and 4C, the sustain gap between the lower electrodes 121 is inside the sustain gap between the upper electrodes 122.

The relative positions of the upper electrodes to the lower electrodes in the present invention will be described in detail.

Figure 2A:
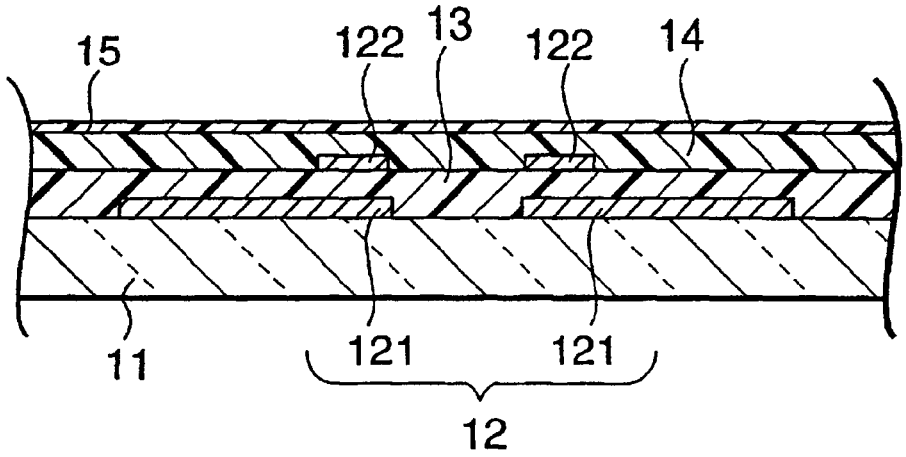
FIGS. 2A, 2B and 2C are cross sections of embodiments of electrode pairs and dielectric layers according to the present invention.

In FIG. 1A, the upper electrodes 122 are formed on the dielectric layer 13 in the sustain gap including end portions of the lower electrodes 121 of the surface-discharge electrode pair 12 on the side of the discharge gap therebetween, such that thickness of the dielectric layer 14 at the end portions of the discharge gap between the lower electrodes 121 is reduced due to the presence of the upper electrodes 122.

Figure 1B:
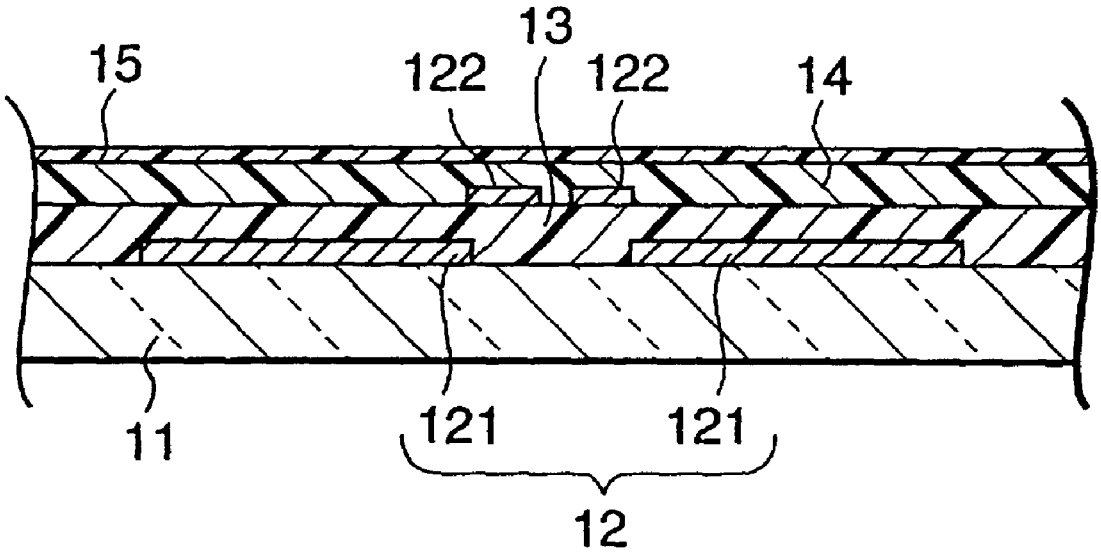

In FIG. 1B, the upper electrodes 122 are not substantially overlapped on the lower electrodes 121. That is, outer ends of the upper electrodes 122 are substantially coincident with the inner ends of the lower electrodes 121, respectively.

In FIG. 2A, the upper electrodes 122 are completely overlapped on the lower electrodes 121 with the inner ends of the upper electrodes 122 being coincident with the inner ends of the lower electrodes 121, respectively.

Figure 2B:
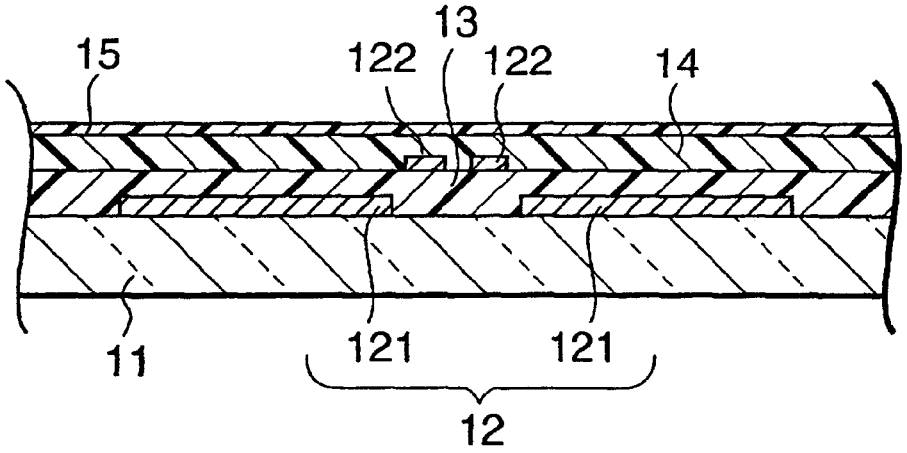
Figure 2C:
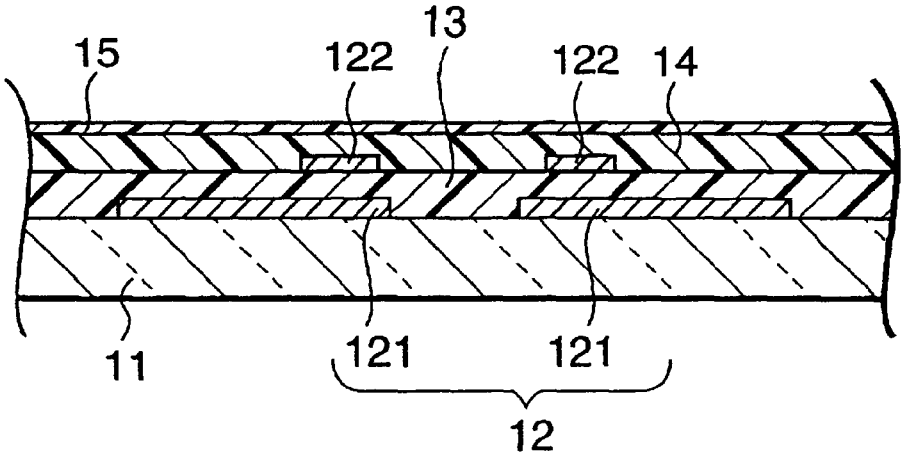
Figure 3A:
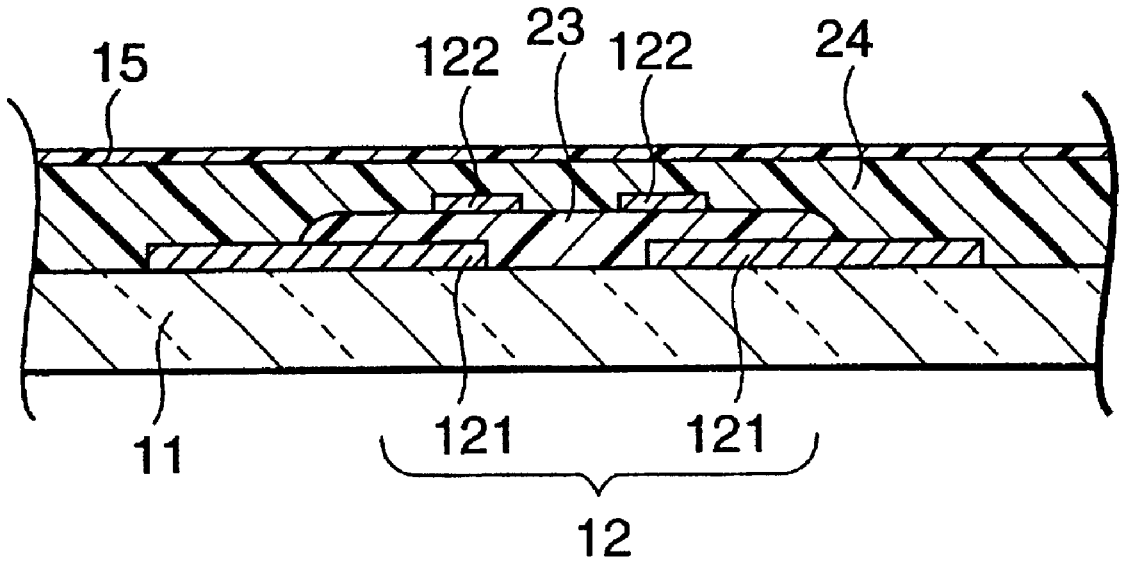
FIGS. 3A and 3B are cross sections of embodiments of electrode pairs and dielectric layers according to the present invention.
Figure 3B:
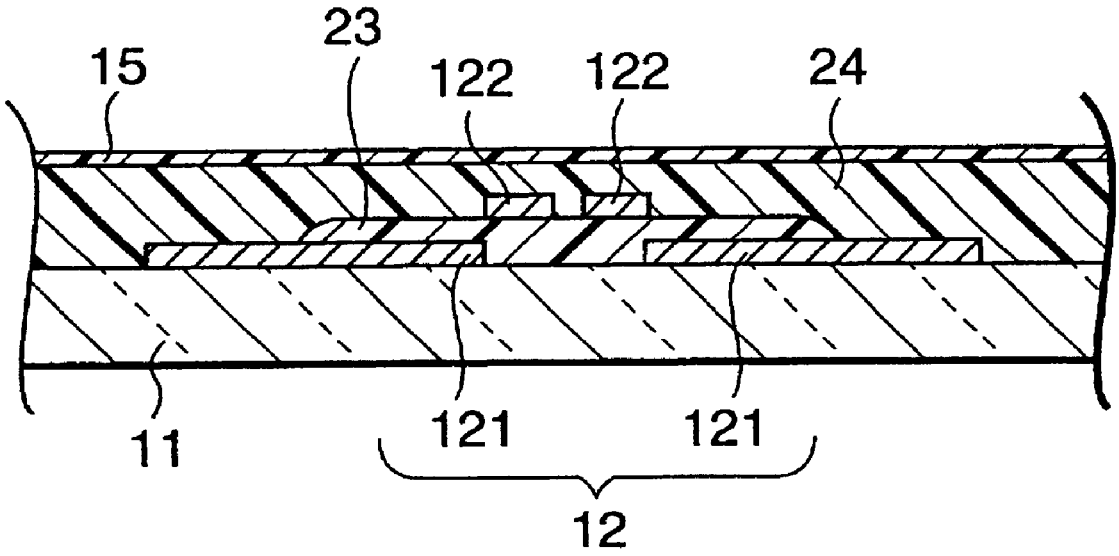

In FIG. 2B, the upper electrodes 122 are overlapped on the discharge sustain gap between the lower electrodes 121.

In FIG. 2C, the inner ends of the upper electrodes 122 are completely overlapped on the lower electrodes 121 with the inner ends of the upper electrodes 122 being positioned outside the inner ends of the lower electrodes 121.

Each of embodiments shown in FIGS. 3A and 3B and FIGS. 4A, 4B and 4C differs from the embodiments shown in FIGS. 1A and 1B and FIGS. 2A and 2B in that the lower dielectric layer 23 is partially formed on the first glass substrate 11 such that it covers at least the sustain gap between the lower electrodes 121. The upper electrodes 122 on a lower dielectric layer 23 such that it is separated from the lower electrodes 121 by the dielectric layer 23.

Figure 5A:
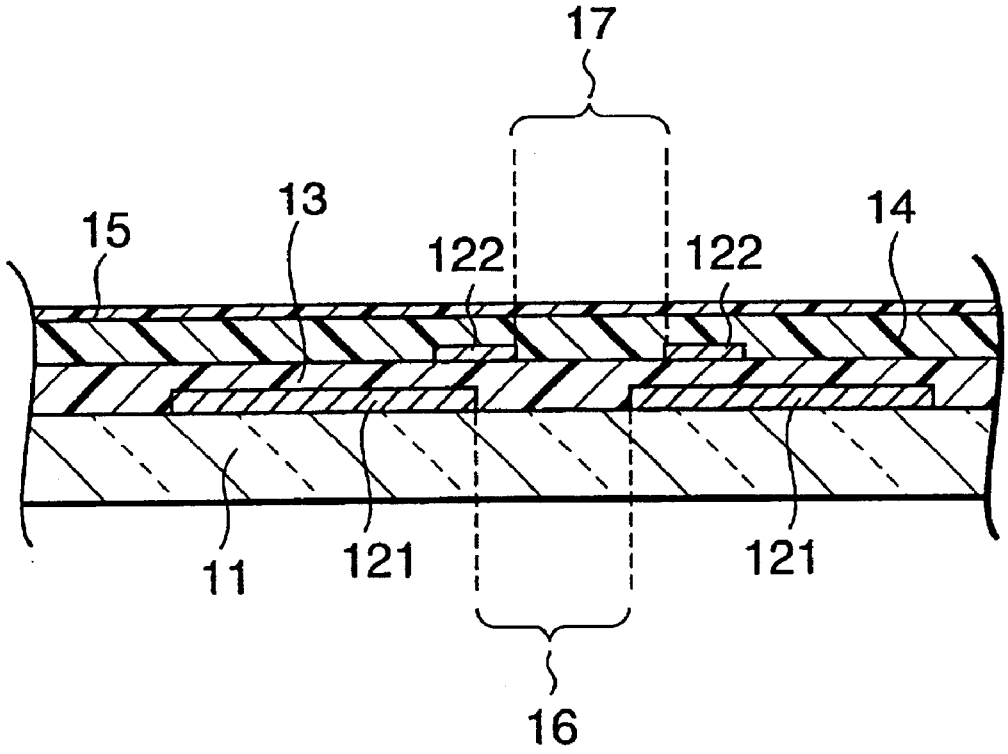
FIGS. 5A and 5B are cross sections of embodiments of electrode pairs and dielectric layers according to the present invention.
Figure 5B:
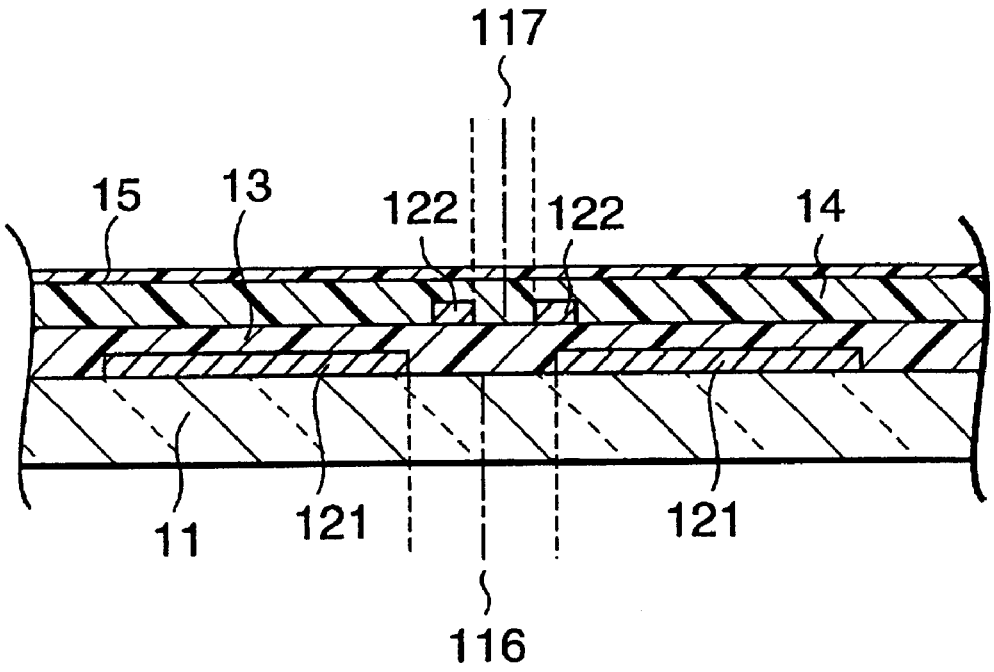

The electrode pairs and the dielectric layers of the present invention are not limited to those shown in FIGS. 1A to 4C. For example, a sustain gap 17 between the upper electrodes 122 may be partially overlapped with a sustain gap 16 between the lower electrodes 121, as shown in FIG. 5A. Alternatively, as shown in FIG. 5B, it is possible to employ an asymmetrical structure in which the sustain gap 17 between the upper electrodes 122 is within the sustain gap 16 between the lower electrodes 121 with a center line 117 of the sustain gap 17 between the upper electrodes 122 being inconsistent with a center line 116 of the sustain gap 16 between the lower electrodes 121.

That is, according to the structure of the plasma display panel of the present invention, it is possible to optimally design the thickness of dielectric layer, which affects the easiness of obtaining discharge between the surface-discharge electrode pair on one and the same surface of the substrate. In detail, it is possible to restrict current density of surface-discharge while keeping electric field intensity in the discharge space around the opposing end portions of the electrodes, which strongly affects the easiness of discharge, high. Therefore, it is possible to satisfy both the requirement of lower discharge sustaining voltage and the requirement of high light emitting efficiency to thereby improve the display quality of the plasma display panel.

The above mentioned merits obtainable by the structure according to the present invention are based on the following knowledge's:

(i) By making the dielectric layer on the discharge electrodes thick, discharge current density is limited and light emitting efficiency is improved.

(ii) By making the dielectric layer on the discharge electrodes thick, discharge sustaining voltage is increased, so that a drive of the plasma display panel becomes difficult.

(iii) When a constituent ratio of gaseous materials for emitting ultraviolet light utilized to excite a fluorescent member is increased in a case where discharge gas containing rare gas such as helium (He) or neon (Ne) is used as a main constituent, the light emitting efficiency is improved.

(iv) When a constituent ratio of gaseous materials for emitting ultraviolet light utilized to excite a fluorescent member is increased in a case where discharge gas containing rare gas such as He or Ne is used as a main constituent, voltage for sustaining discharge is increased, so that the drive of the plasma display panel becomes difficult.

(v) When thickness of a portion of a dielectric layer on surface-discharge electrodes, particularly, thickness of the dielectric layer on inner end portions of the surface-discharge electrodes, is small, it is possible to restrict the voltage for sustaining discharge within a practical range, even if thickness of the dielectric layer covering other portions of the surface-discharge electrodes is large or even if the constituent ratio of gaseous materials for emitting ultraviolet light is high.

Although the features of the above-described embodiments of the electrode pairs and the dielectric layers of the present invention are illustrated in cross section, these embodiments can be applied to all practical embodiments to be described hereinafter. That is, though, in a first to sixth embodiments to be described, the electrode pair has a structure shown in FIG. 1A or FIG. 3A, it is, of course, possible to employ any one of the electrode pairs shown in FIGS. 1B, 2A, 2B, 2C, 5A and 5B in the first to sixth embodiments.

FIGS. 6A and 6B to FIGS. 17A and 17B show the first to sixth embodiments of the present invention in more detail.

Furthermore, in the embodiments of the present invention, the lower electrodes and the upper electrodes are led out through low resistance wiring and connecting wiring. However, it should be noted that a structure of the plasma display panel in which the low resistance wiring and the connecting wiring are not used and the lower electrodes and the upper electrodes are electrically connected to peripheral portions of the panel is a modification of each of the first to sixth embodiments.

First, the first embodiment of the present invention will be described with reference to FIGS. 6A and 6B and FIGS. 7A and 7B. It should be noted that, in FIGS. 6A and 6B to FIGS. 17A and 17B, an even numbered figure and a subsequent odd numbered figure are paired to show the features of one embodiment of the present invention. In each embodiment, the figure having affix A is a plan view and the figure having affix B is a cross section taken along a line A–A' or B–B' in the figure having affix A to clarify a difference thereof from the other embodiments.

Figure 6A:
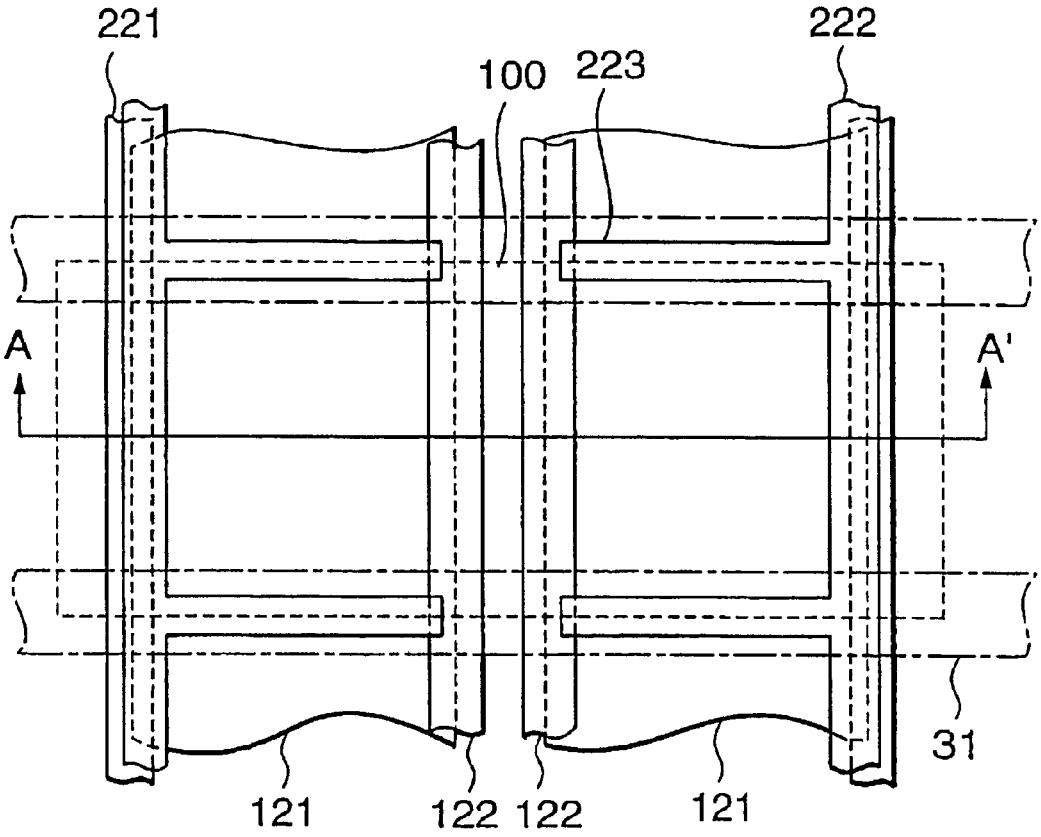
FIG. 6A is a plan view of a first embodiment of the present invention.

FIG. 6A is a plan view of a first glass substrate. In order to clarify a layout of elements on the first glass substrate, partition wall regions 31 of a second glass substrate is also shown therein by dotted line. Therefore, the partition wall regions 31 of the second glass substrate are omitted in FIG. 7B. In FIG. 6A, a line A–A' runs between the partition wall regions 31 of the second glass substrate in parallel thereto.

Figure 6B:
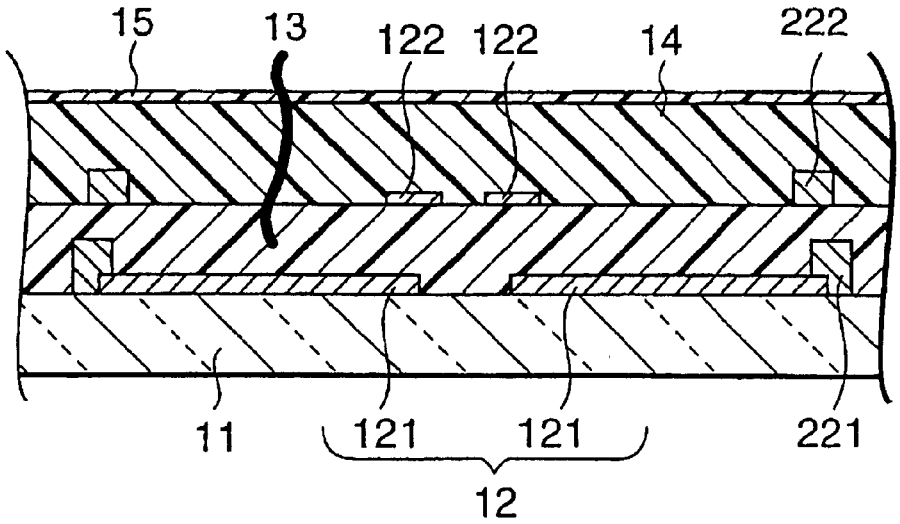
FIG. 6B is a cross section taken along a line A–A' in FIG. 6A.

First, as shown in FIG. 6B, lower electrodes 121 are formed on a substantially flat surface of the first glass substrate 11 and first low resistance wiring 221 are formed on and along outer end portions of the lower electrodes 121. The low resistance wiring 221 function to reduce a resistance of the connecting wiring of the lower electrodes 121 and are formed of a low resistance material in such form as a thin film of a metal material containing at least aluminum, copper, chromium and silver, particles of the same metal materials or a sintered mixture of the metal particles and a low melting point glass material.

Thereafter, a lower dielectric layer 13 is formed to cover all of the lower electrodes 121 and the first low resistance wiring 221 thereon. Upper electrodes 122 are formed on the lower dielectric layer 13 correspondingly to the lower electrodes 121. Then, an upper dielectric layer 14 is formed on the upper electrodes 122 such that a surface of a protective film 15 such as a MgO film to be formed thereon becomes substantially flat. The MgO film shall be exposed to a discharge space as to be described later.

A second low resistance wiring 222 of the same material as the low resistance material is formed on the same flat surface of the upper electrodes 122.

Figure 7A:
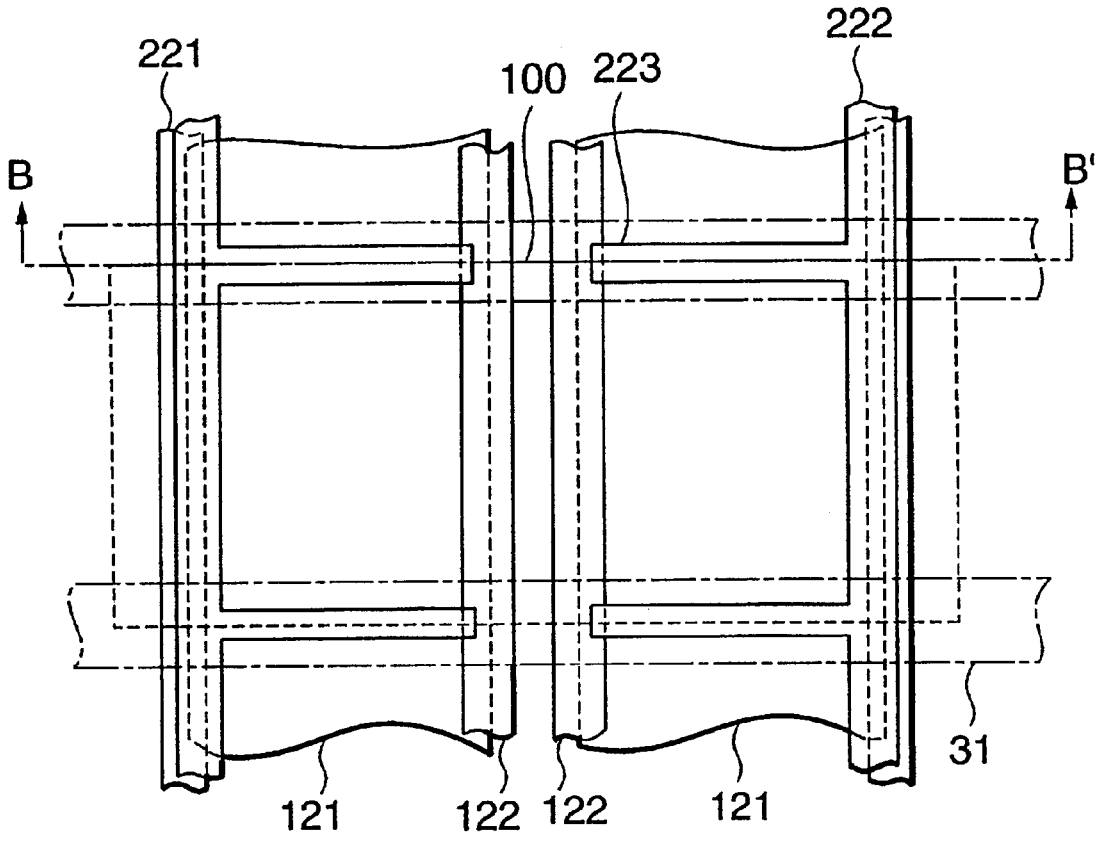
FIG. 7A is a plan view of the first embodiment of the present invention.

FIG. 7A is a plan view of the first glass substrate shown in FIG. 6A and a line B–B' in FIG. 7A runs along a center of the partition wall region 31 of the second glass substrate and in parallel to the partition wall region 31.

Figure 7B:
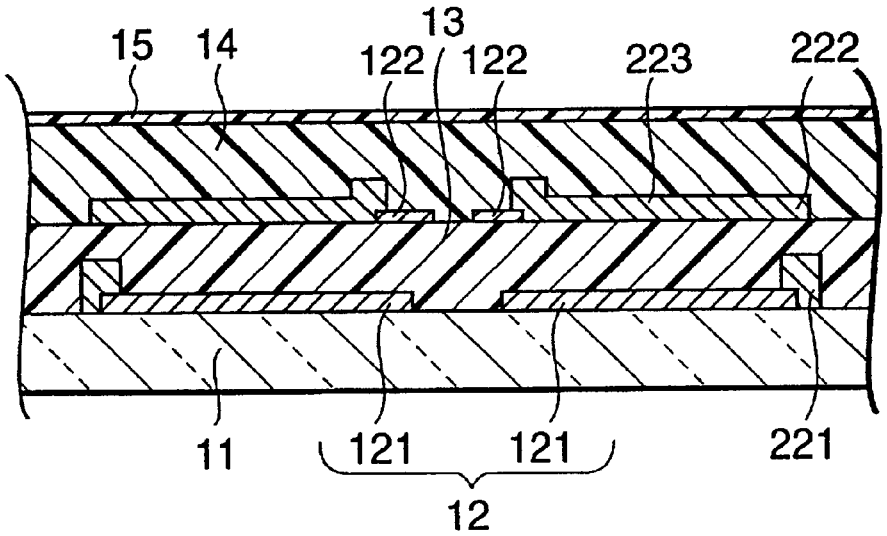
FIG. 7B is a cross section taken along a line B–B' in FIG. 7A.

FIG. 7B shows the second low resistance wiring 222 formed on the same plane as that on which the upper electrodes 122 are formed and connected to the upper electrodes 122. In FIG. 7B, the upper electrodes 122 are connected to the second low resistance wiring 222 through a connecting wiring 223. In this embodiment, the connecting wiring 223 is formed of the same material as that of the second low resistance wiring 222. However, it is possible to form the connecting wiring 223 by using other material than the low resistance material of the second low resistance wiring 222 or by using the same material as that of the upper electrodes 122.

Regions surrounded by broken lines in FIGS. 6A and 7A show one of discharge cells 100 of the PDP. That is, FIGS. 6A and 7A show a fact that the second low resistance wiring 222 and the connecting wiring 223 are formed in all of the discharge cells 100 in the same manner.

In this embodiment, the first low resistance wiring 221 and the second low resistance wiring 222 extend on the first glass substrate 11 in parallel to the lower electrodes 121 and the upper electrodes 122 and are connected together at a side portion of the panel, so that the first and second low resistance wiring becomes at equipotential.

With using the above mentioned structure of the PDP and the above mentioned fabrication method, it is possible to neglect a variation of thickness of the dielectric layer on the upper electrodes 122 in a sense that a display of the PDP is possible practically. This is because the double layer structure of the electrodes and the fabrication method of the present invention make possible to form the upper electrodes 122 having uniform width throughout the panel.

A second embodiment of the present invention will be described with reference to FIGS. 8A and 8B and FIGS. 9A and 9B.

Figure 8A:
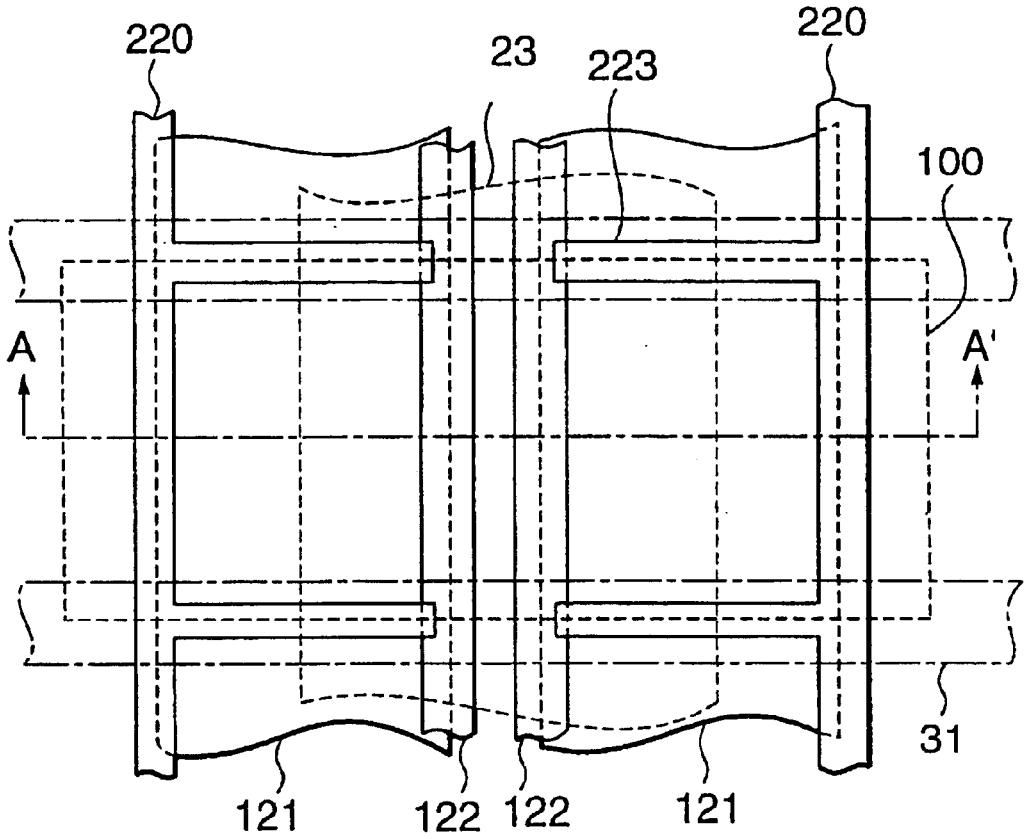
FIG. 8A is a plan view of a second embodiment of the present invention.
Figure 8B:
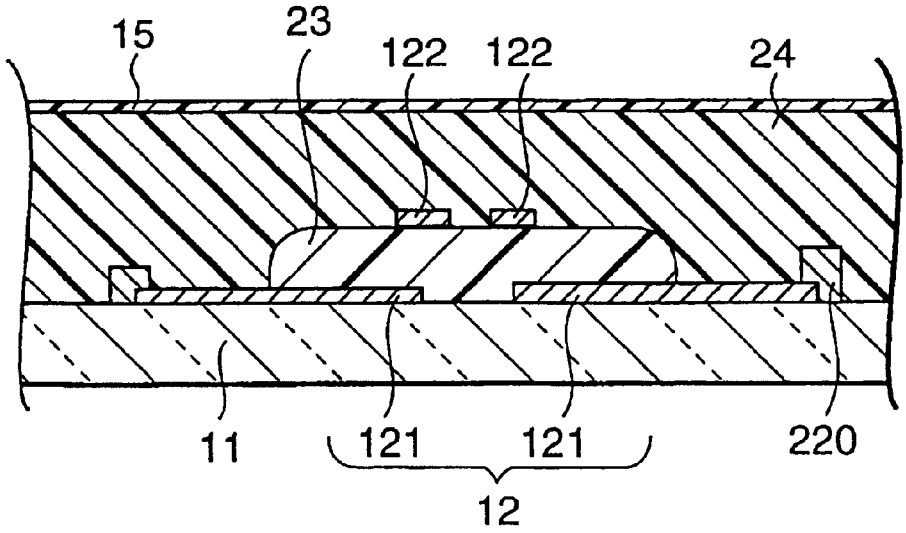
FIG. 8B is a cross section taken along a line A–A' in FIG. 8A.
Figure 9A:
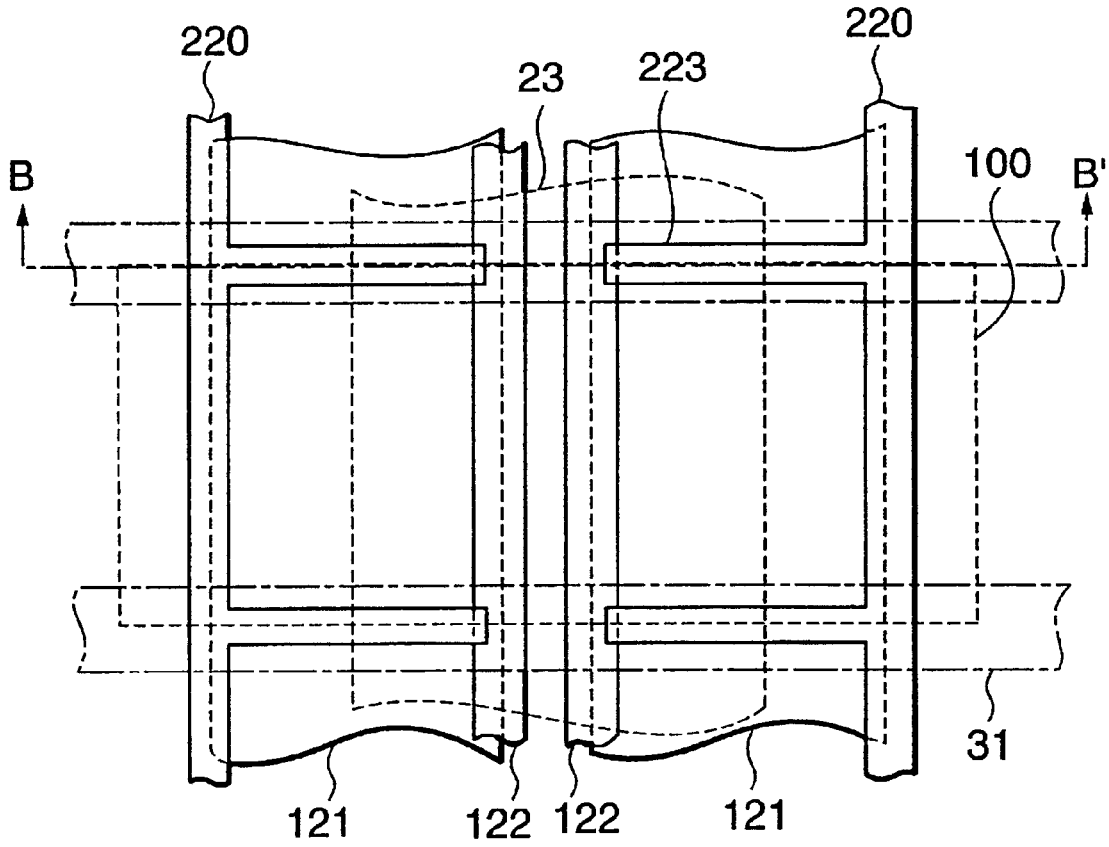
FIG. 9A is a plan view of the second embodiment of the present invention.
Figure 9B:
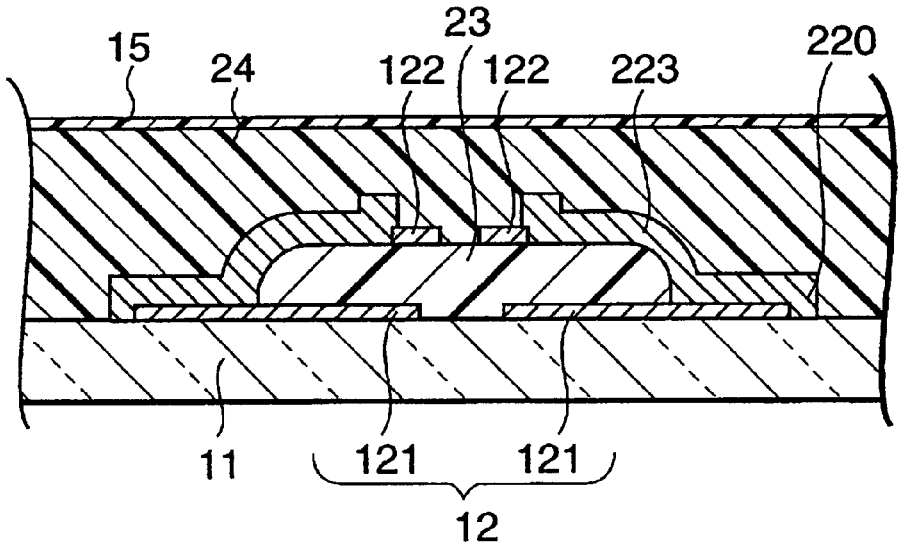
FIG. 9B is a cross section taken along a line B–B' in FIG. 9A.

In the second embodiment, a lower dielectric layer 23 is formed partially on the first glass substrate 11 such that the lower dielectric layer 23 covers at least a sustain gap between the inner ends of the opposing lower electrodes 121 and the upper electrodes 122 are formed on the lower dielectric layer 23 such that the upper electrodes 122 correspond to the lower electrodes 121, respectively, as shown in FIGS. 8B and 9B. In order to connect the upper electrodes 122 to the respective lower electrodes 121 and to reduce a resistance of a connecting wiring from the electrodes 121 and 122, a low resistance wiring 220 is formed of a low resistance material as shown in FIG. 9B.

As shown in FIG. 9B, the upper electrodes 122 are led out through the connecting wiring 223 and the low resistance wiring 220 and connected to the respective lower electrodes 121. Though the connecting wiring 223 and the low resistance wiring 220 are formed of the same material, the connecting wiring 223 may be formed of other material than that of the low resistance wiring 220 similarly to the first embodiment. Alternatively, the connecting wiring 223 may be formed of the same material as that of the upper electrodes 122.

With the use of the lower dielectric layer 23 having the above-mentioned structure, the connecting wiring 223 connects the upper electrodes 122 to the lower electrodes 121 in an area in which the upper electrodes 122 are close to the lower electrodes 121. Therefore, it is possible to reduce a potential difference between the lower electrodes 121 and the upper electrodes 122, compared with the first embodiment. Furthermore, since the low resistance wiring are formed simultaneously with respect to the lower electrodes and the upper electrodes, the number of fabrication steps thereof is reduced compared with the first embodiment, so that it is possible to reduce the fabrication cost and to improve the reliability thereof due to the reduced fabrication steps.

Now, a third embodiment of the present invention will be described with reference to FIGS. 10A and 10B and FIGS. 11A and 11B.

Figure 10A:
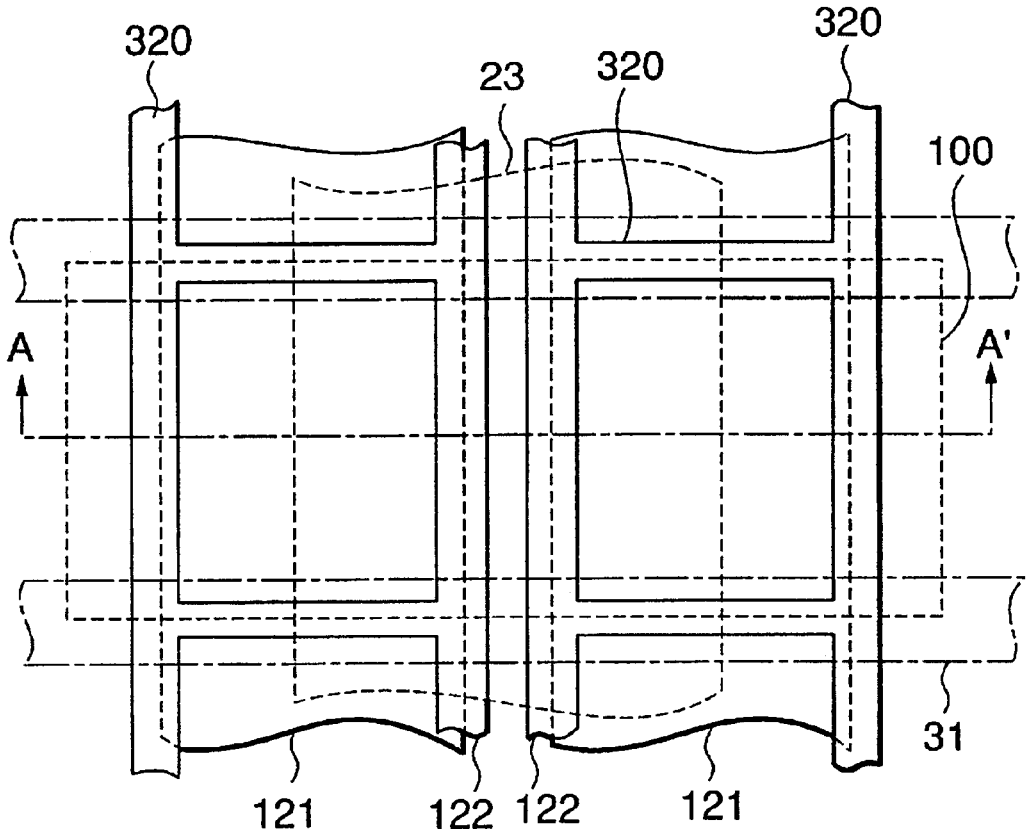
FIG. 10A is a plan view of a third embodiment of the present invention.
Figure 10B:
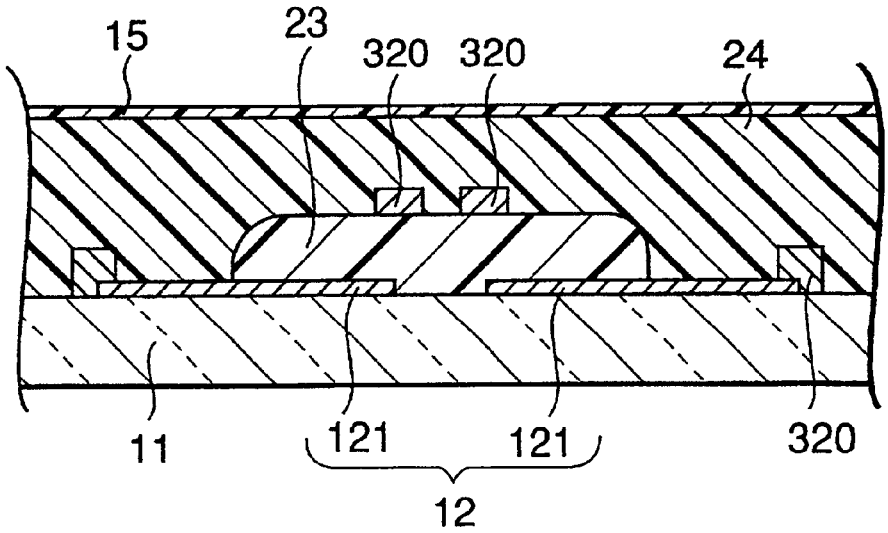
FIG. 10B is a cross section taken along a line A–A' in FIG. 10A.
Figure 11A:
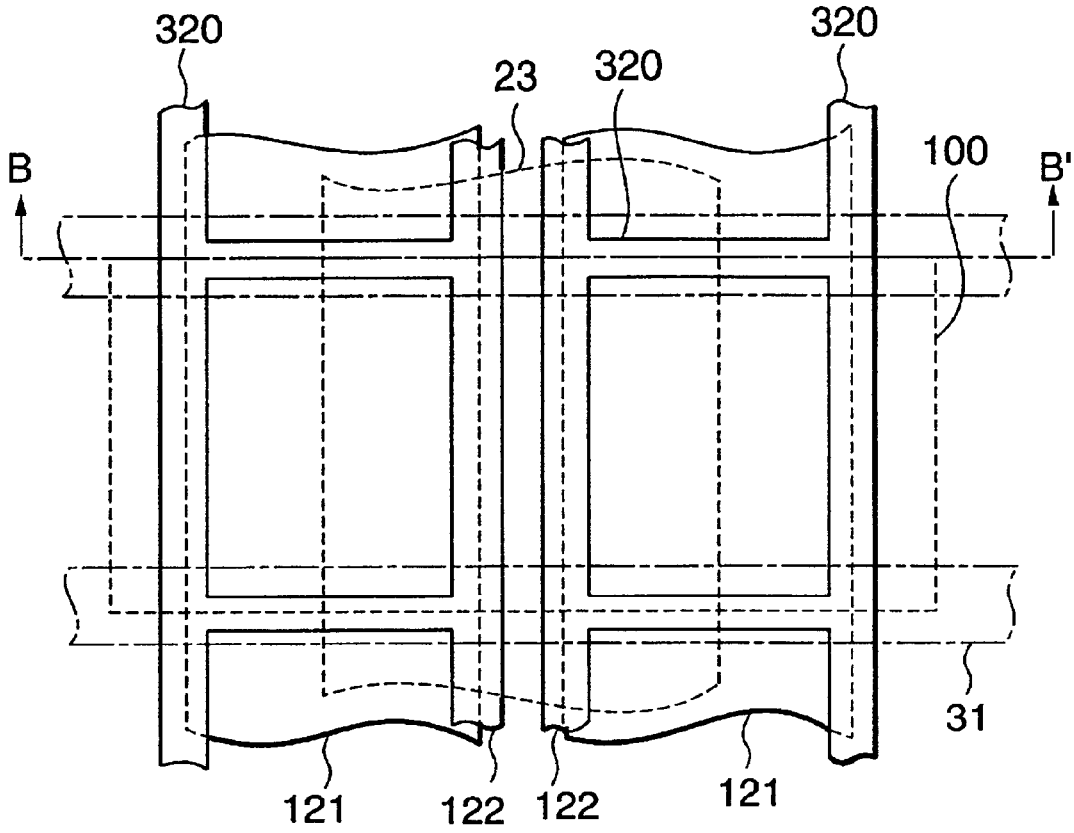
FIG. 11A is a plan view of the third embodiment of the present invention.
Figure 11B:
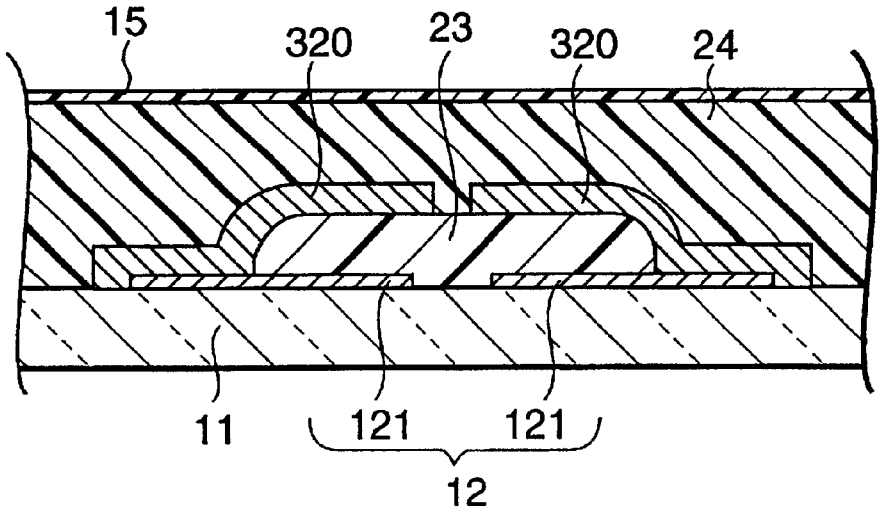
FIG. 11B is a cross section taken along a line B–B' in FIG. 11A.
Figure 12A:
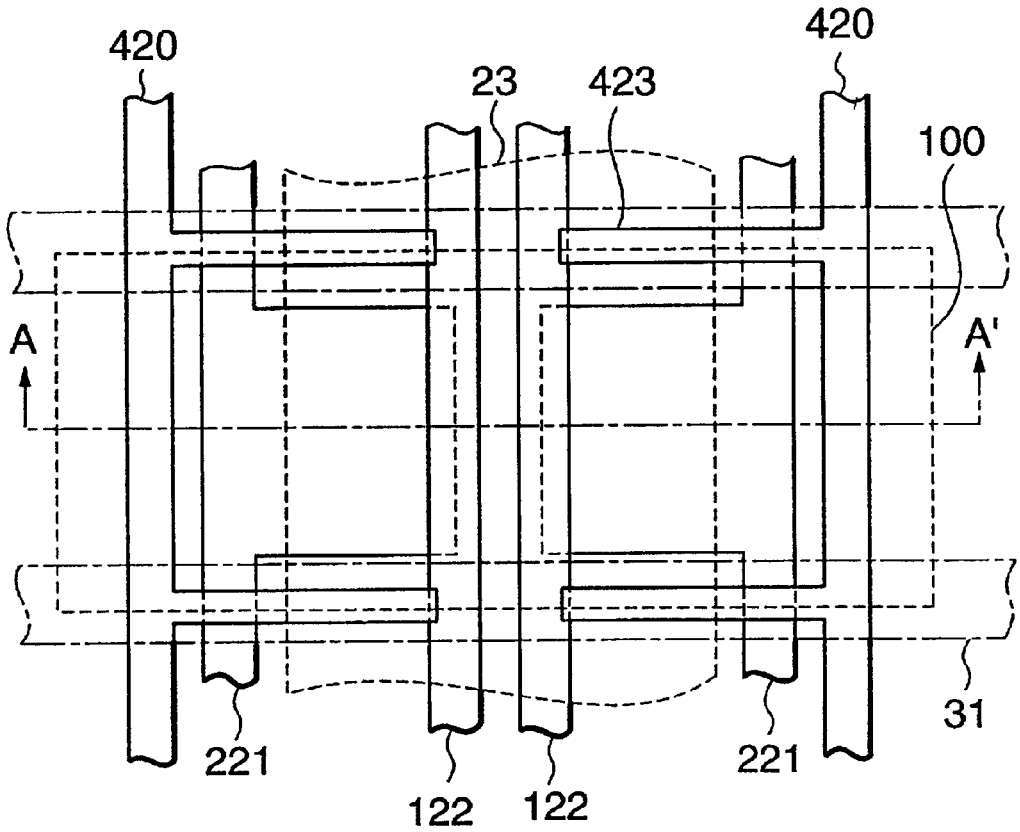
FIG. 12A is a plan view of a fourth embodiment of the present invention.
Figure 12B:
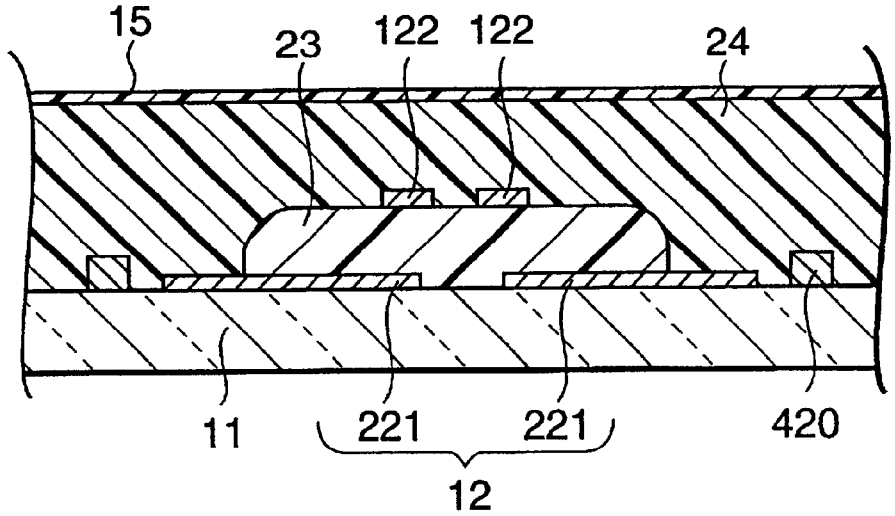
FIG. 12B is a cross section taken along a line A–A' in FIG. 12A.

A construction of the third embodiment shown in FIGS. 10A and 10B is substantially the same as the second embodiment. However, as shown in FIG. 11B, the upper electrodes 122 are formed of the same low resistance material of the low resistance wiring 320 as portions of the latter. Therefore, it is possible to eliminate the fabrication step of forming the upper electrodes to thereby simplify the fabrication of the PDP.

A fourth embodiment of the present invention will be described with reference to FIGS. 12A and 12B and FIGS. 13A and 13B.

Figure 13A:
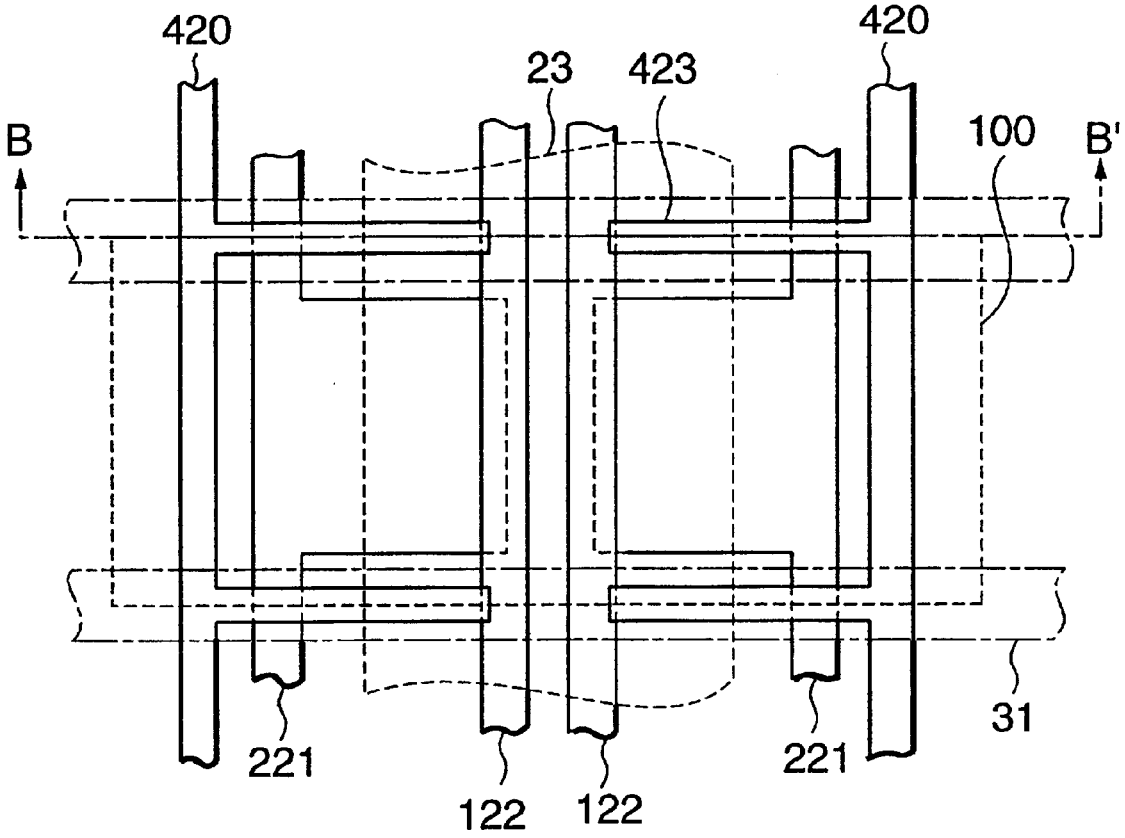
FIG. 13A is a plan view of the fourth embodiment of the present invention.
Figure 13B:
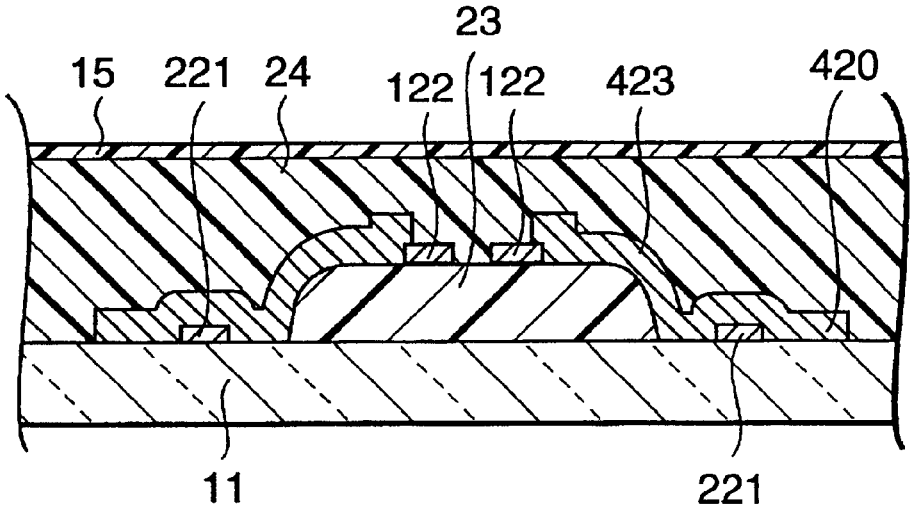
FIG. 13B is a cross section taken along a line B–B' in FIG. 13A.
Figure 14A:
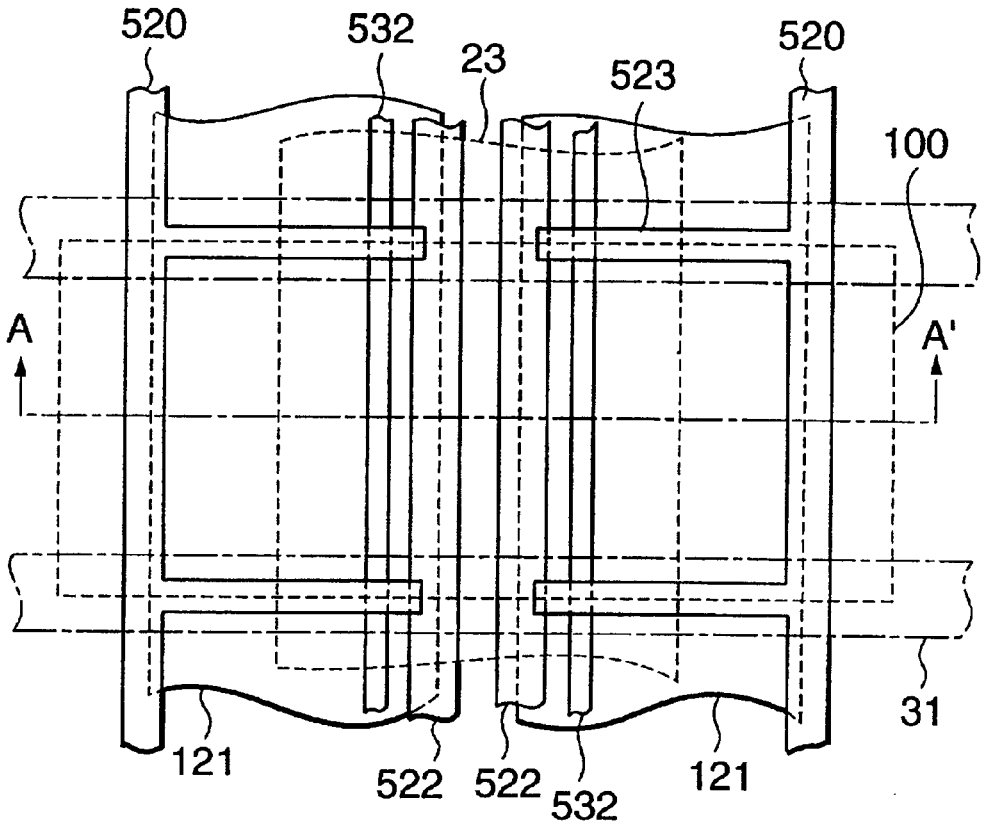
FIG. 14A is a plan view of a fifth embodiment of the present invention.
Figure 14B:
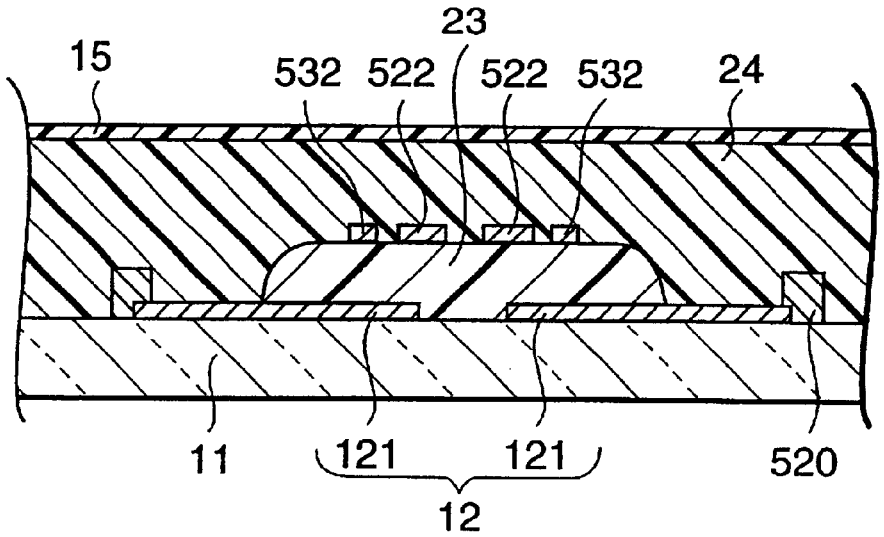
FIG. 14B is a cross section taken along a line A–A' in FIG. 14A.
Figure 15A:
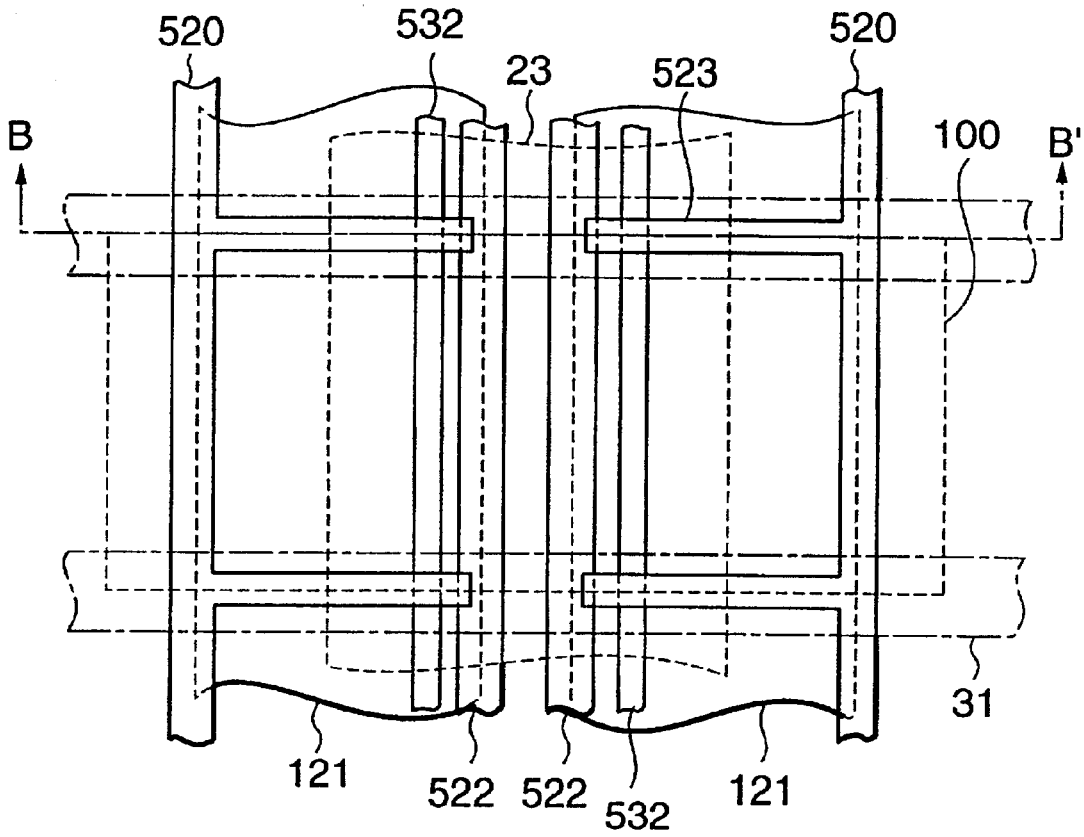
FIG. 15A is a plan view of the fifth embodiment of the present invention.
Figure 15B:
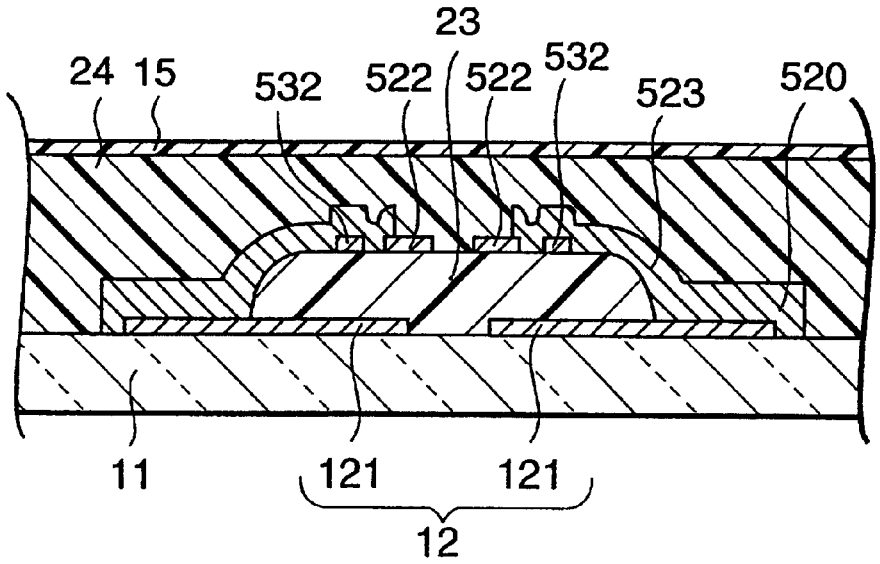
FIG. 15B is a cross section taken along a line B–B' in FIG. 15A.
Figure 16A:
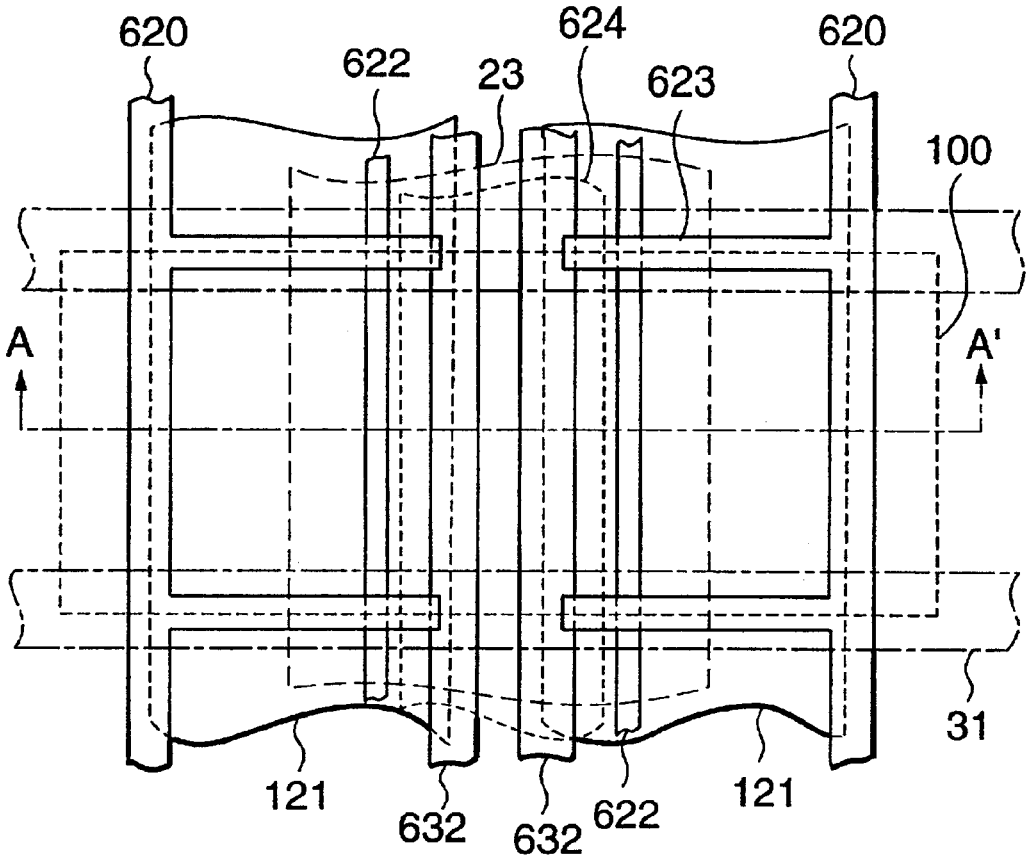
FIG. 16A is a plan view of a sixth embodiment of the present invention.
Figure 16B:
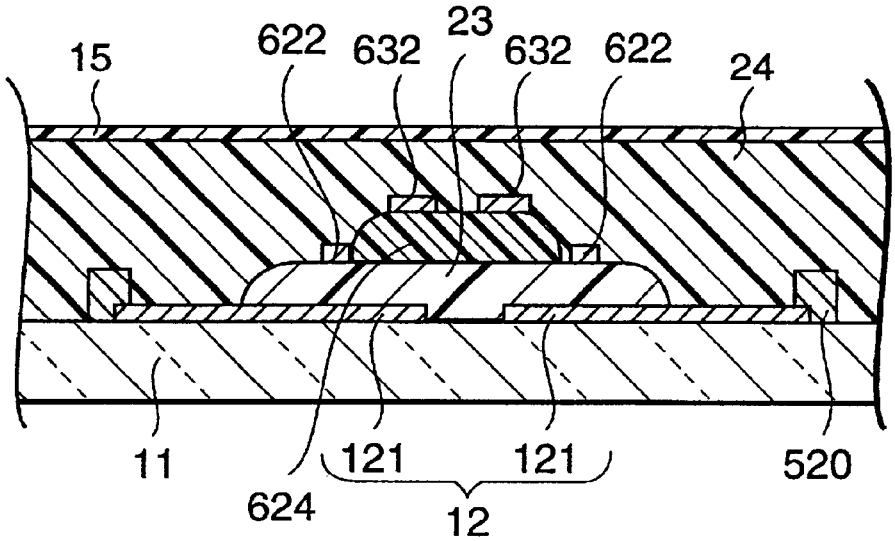
FIG. 16B is a cross section taken along a line A–A' in FIG. 16A.

In the fourth embodiment, the lower electrodes 221 are formed separately from low resistance wiring 420 and connected to the upper electrodes 122 and the low resistance wiring 420 through a connecting wiring 423 in regions corresponding to the partition wall regions 31 of the second glass substrate as shown in FIG. 13B. In this embodiment, the connecting wiring 423 and the low resistance wiring 420 are formed simultaneously. However, the connecting wiring 423 may be formed in other step than that of forming the low resistance wiring 420. Furthermore, in this embodiment, the same material may be used to form both the connecting wiring 423 and the upper electrodes 122. Alternatively, it is possible to unite the upper electrodes 122, the connecting wiring 423 and the low resistance wiring 420.

A fifth embodiment of the present invention will be described with reference to FIGS. 14A and 14B and FIGS. 15A and 15B.

In this embodiment, the lower dielectric layer 23 is formed to cover the lower electrodes 121 and a plurality of discrete upper electrodes are formed on the lower dielectric layer 23. The upper electrodes are constituted with first upper electrodes 522 and second upper electrodes 532. In this embodiment, the first upper electrodes 522 and the second upper electrodes 532 are formed of the same material in the same step. However, the first upper electrodes 522 and the second upper electrodes 532 may be formed of different materials in different steps. Alternatively, the upper electrode may be formed as three or more discrete electrodes.

A sixth embodiment of the present invention will be described with reference to FIGS. 16A and 16B and FIGS. 17A and 17B.

In this embodiment, the lower electrodes 121 is covered by the lower dielectric layer 23 formed partially on the first glass substrate and first upper electrodes 622 are formed on the lower dielectric layer 23 correspondingly to the lower electrodes 121. Furthermore, an intermediate dielectric layer 624 is formed on the lower dielectric layer 23 such that the intermediate dielectric layer 624 covers a sustain gap between the opposing lower electrodes 121. In this case, a configuration of the intermediate dielectric layer 624 is enough to cover at least the sustain gap between the opposing lower electrodes 121. Therefore, the intermediate dielectric layer 624 may be extended laterally from the cross section shown in FIG. 16B to cover a low resistance wiring 620.

Thereafter, second upper electrodes 632 are formed on the intermediate dielectric layer 624 correspondingly to the lower electrodes 121. Finally, the first glass substrate 11 is completely covered by the upper dielectric layer 24.

Figure 17A:
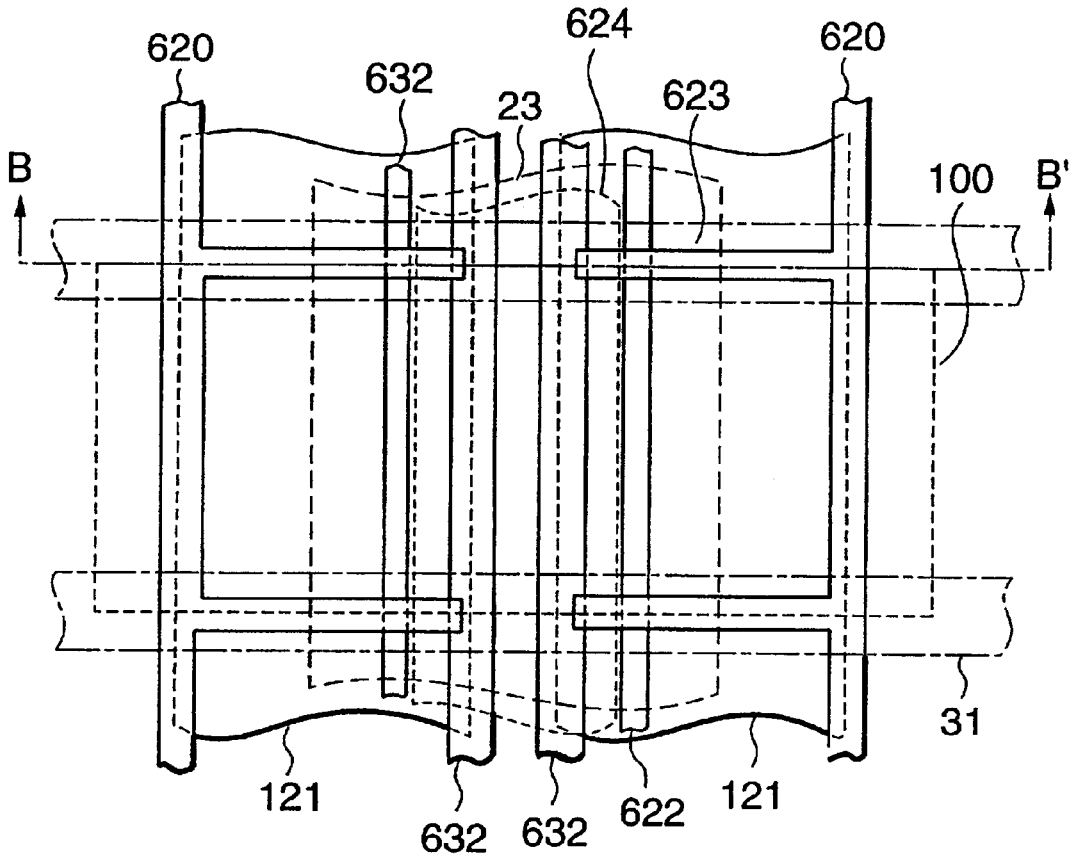
FIG. 17A is a plan view of the sixth embodiment of the present invention.
Figure 17B:
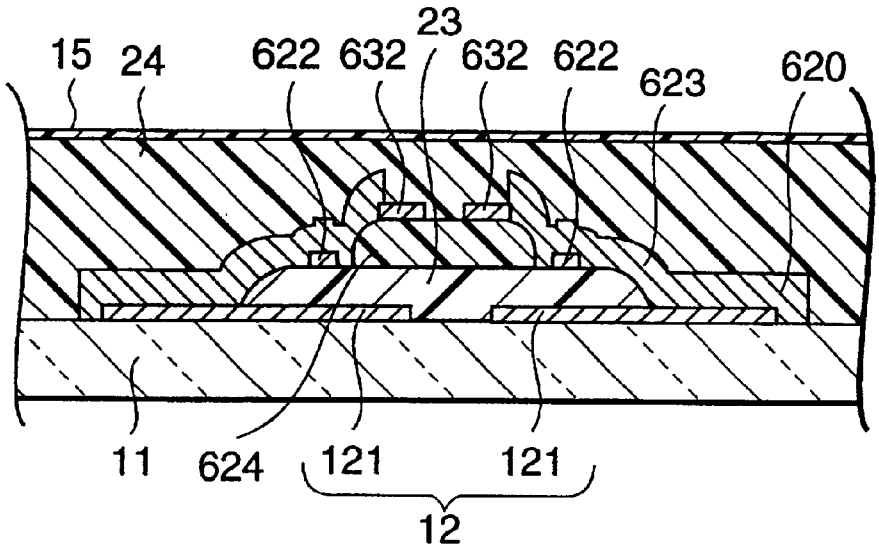
FIG. 17B is a cross section taken along a line B–B' in FIG. 17A.

FIGS. 17A and 17B shows a state that the first upper electrodes 622 and the second upper electrodes 632 are connected mutually by a connecting wiring 623 and to the low resistance wiring 620. Furthermore, in this embodiment, the connecting wiring 223 and the upper electrodes 122 may be formed of the same material and the upper electrodes 122, the connecting wiring 423 and the low resistance wiring 420 may be united.

In this embodiment, the first upper electrodes 622 and the second upper electrodes 632 are symmetrically formed about a center line of the sustain gap between the opposing lower electrodes 121 as electrode pairs. However, the present invention is not limited thereto. For example, when the first upper electrodes 622 and the second upper electrodes 632 are not symmetrical as electrode pairs or when the first upper electrodes 622 and the second upper electrodes 632 are not formed on the same plane as electrode pairs, other upper electrodes may be formed additionally on a different plane in a dielectric layer.

In the latter case, that is, when the first upper electrodes 622 and the second upper electrodes 632 are not formed on the same plane as electrode pairs and other upper electrodes are formed additionally on a different plane in a dielectric layer, one of the upper electrode pairs, a distance between the upper electrodes of which is shortest, plays the role of surface-discharge mainly. Therefore, the dielectric layer is formed to cover at least this upper electrode pair.

Now, a fabrication method for fabricating the PDP according to the present invention will be described with reference to FIGS. 18A to 18C and FIGS. 19A to 19C.

Figure 18A:
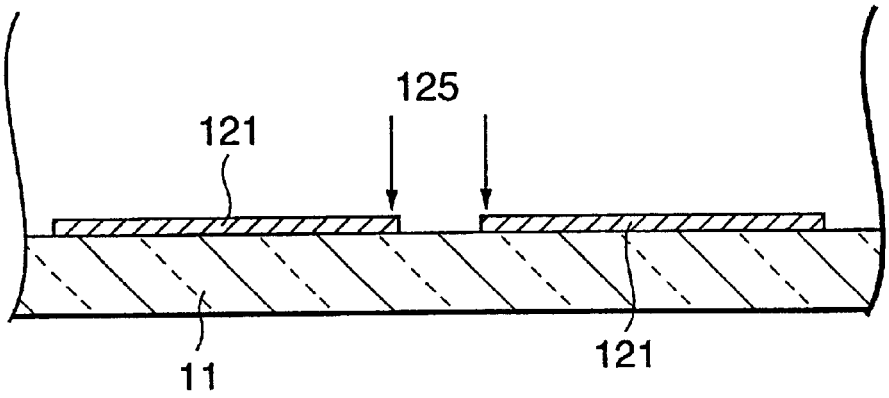
FIGS. 18A, 18B and 18C are cross sections of the second embodiment of the present invention, showing fabrication steps of a fabrication method according to the present invention.
Figure 18B:
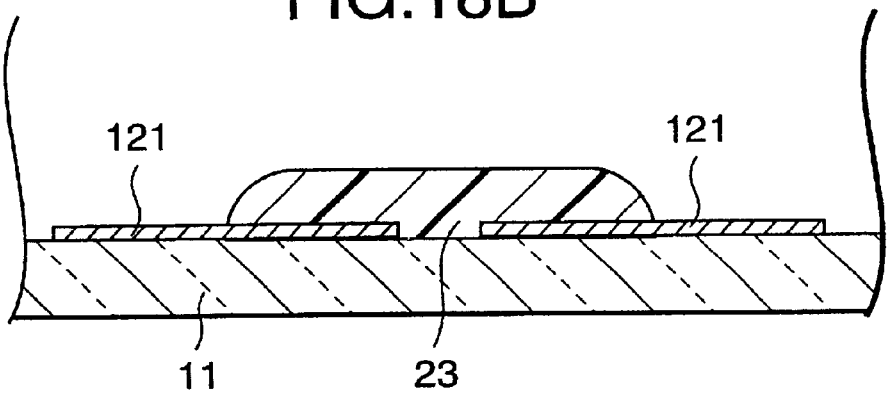
Figure 18C:
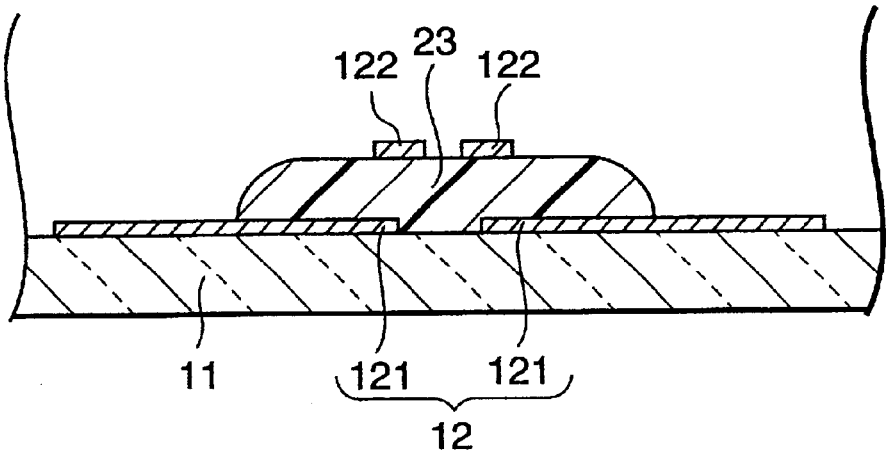
Figure 19A:
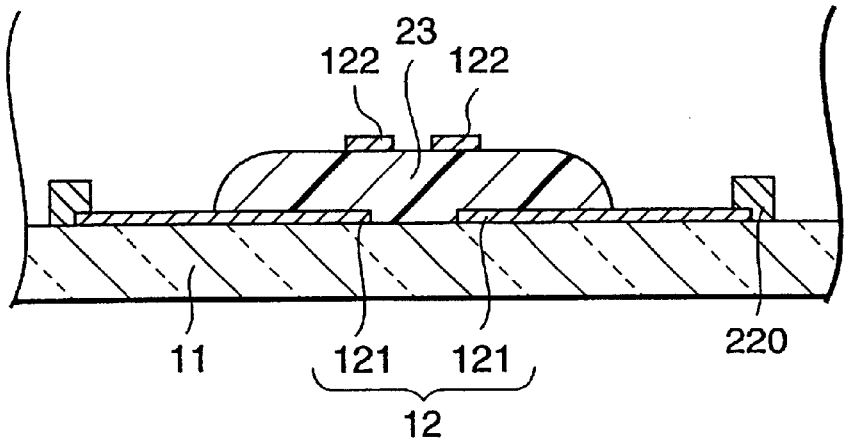
FIGS. 19A, 19B and 19C are cross sections of the second embodiment of the present invention, showing fabrication steps subsequent to the fabrication step shown in FIG. 18C.
Figure 19B:
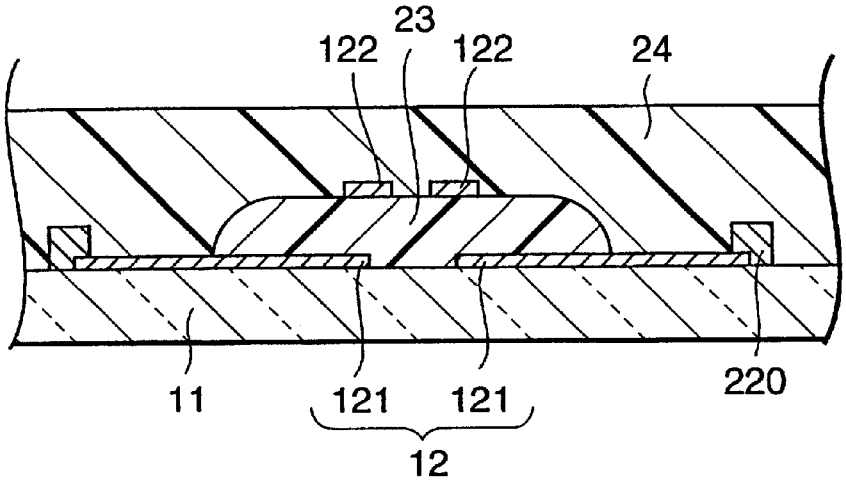
Figure 19C:
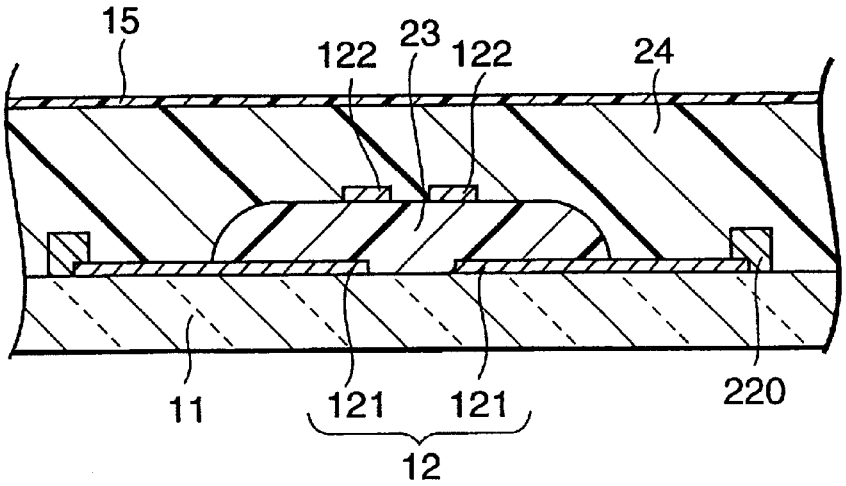

As shown in FIG. 18A, the lower electrodes 121 having a desired configuration are formed on the first flat glass substrate 11. Thereafter, the lower dielectric layer 23 for separating the upper electrodes 122 from the lower electrodes 121 is formed on the lower electrodes 121 by putting a suitably shaped material paste of the lower dielectric layer 23 on the lower electrodes 121 and sintering it, as shown in FIG. 18B. Thereafter, as shown in FIG. 18C, the upper electrodes 122 are formed on the lower dielectric layer 23 correspondingly to the lower electrodes 121. Thereafter, as shown in FIG. 19A, the upper electrodes 122 are formed on the lower dielectric layer 23 and the low resistance wiring 220 of a low resistance wiring material are formed on the outer end portions of the lower electrodes 121 to reduce the resistance value of the lead wiring of the upper electrodes 122 and the lower electrodes 121 and to connect the upper electrodes 122 to the lower electrodes 121. After the upper dielectric layer 24, which is substantially flat, is formed on the first glass substrate 11 to cover the latter completely as shown in FIG. 19B, the protective film 15 such as a MgO film is formed to complete the structure of the PDP on the side of the first glass substrate 11 as shown in FIG. 19C. Thus, the structure of the PDP of the present invention can be realized easily.

This fabrication method of the present PDP will be described in more detail with reference to the embodiment shown in FIGS. 8A to 9B mainly.

First, the lower electrodes 121 of a visible light transmitting material, preferably, transparent, electrically conductive material were formed on the first glass substrate 11 (FIG. 18A) and dielectric paste containing a low melting point glass material mainly was painted on the lower electrodes 121 by screen printing such that at least a discharge sustain gap between inner edge portions 125 of the opposing lower electrodes 121 as the surface-discharge electrode pair and the lower dielectric layer 23 was formed by sintering the dielectric paste (FIG. 18B). In order to form the lower dielectric layer 23 with high positional preciseness, it is possible to use a method, in which a thick light sensitive film is patterned to form an opening and the opening portion is buried with the lower dielectric layer material or a method, in which a light sensitive, dielectric material layer is directly exposed and patterned.

Thereafter, a light sensitive material was formed on the whole surface of the first glass substrate 11 and the light sensitive material was exposed and developed such that a portion of the light sensitive material on the lower dielectric layer 23 in the region on which the upper electrodes 122 are to be formed is removed. Thereafter, the upper electrodes 122 of a transparent, electrically conductive material were formed by using the lift-off method (FIG. 18C). The upper electrodes 122 may be formed of an electrically conductive metal or metal particles and, after the whole surface of the wafer is painted with the electrically conductive material to form a thin film thereof, the upper electrodes 122 having desired shape may be formed through an exposing and developing process. Alternatively, it is possible to form the upper electrodes 122 by patterning them with using the screen printing method.

Thereafter, in order to reduce the resistance of the connecting wiring for the lower electrodes 121 and the upper electrodes 122, the connecting wiring 223 in the form of a thin film of a low resistance material such as a metal material or metal particles, which contains at least aluminum, copper, chromium and silver, etc., or a sintered mixture of the metal particles and, in order to mutually connect the lower electrodes 121 and the upper electrodes 122, a low melting point glass layer is formed on a peripheral portion of the discharge cell 100 shown in FIGS. 8A and 9A, preferably, on the partition wall regions 31 of the second glass substrate with width of the connecting wiring being the same as or smaller than the width of the region 31.

In this fabrication method, the connecting wiring 223 is formed simultaneously with the formation of the low resistance wiring 220 and the latter is formed in the outer end portion of the discharge cell remote from the end portions 125 of the discharge sustaining between the surface-discharge electrode pair parallel in parallel to the lower electrodes 121 (FIG. 19A).

Thereafter, the whole surface of the discharge cells 100 is painted with a dielectric paste mainly containing a low melting point glass material by using the screen printing method and the upper dielectric layer 24 was formed by sintering the paste (FIG. 19B).

It is preferable that the sintering temperature and the softening temperature of the upper dielectric layer 24 are lower than those of the lower dielectric layer 23, respectively. Furthermore, it is preferable that the upper dielectric layer 24 absorbs irregularity of the layers on the substrate due to the presence of the lower dielectric layer 23 and is flattened in the sintering process.

Finally, the protective film 15 such as a MgO film is formed on the upper dielectric layer 24, completing the element of the PDP on the side of the first glass substrate 11 (FIG. 19C).

The construction of the second glass substrate 21 is formed by using a method, which is the same as that used in the conventional PDP shown in FIG. 20.

That is, partition walls 725 are formed on the second glass substrate 721 such a way that display cells each of which becomes a unit for generating discharge are separated from each other and selection electrodes 742, which are orthogonal to the sustaining electrode pairs 712 for scanning the first glass substrate and controlling discharge of the display cell, are formed on the first glass substrate. In order to allow the display cell to emit one of three primary color lights, an inner surface of each display cell, which is surrounded by the partition walls 725, is painted with one of fluorescent materials 744, which is capable of emitting desired one of R, G and B color lights, and sintered.

Finally, the second glass substrate 721 is stuck together with the first glass substrate 11 to seal a discharge space formed therebetween. The color PDP is completed by evacuating the discharge space and filling the discharge space with a discharge gas, which is a gas mixture containing such as xenon for emitting ultraviolet lay for exciting the fluorescent materials.

Figure 20A:
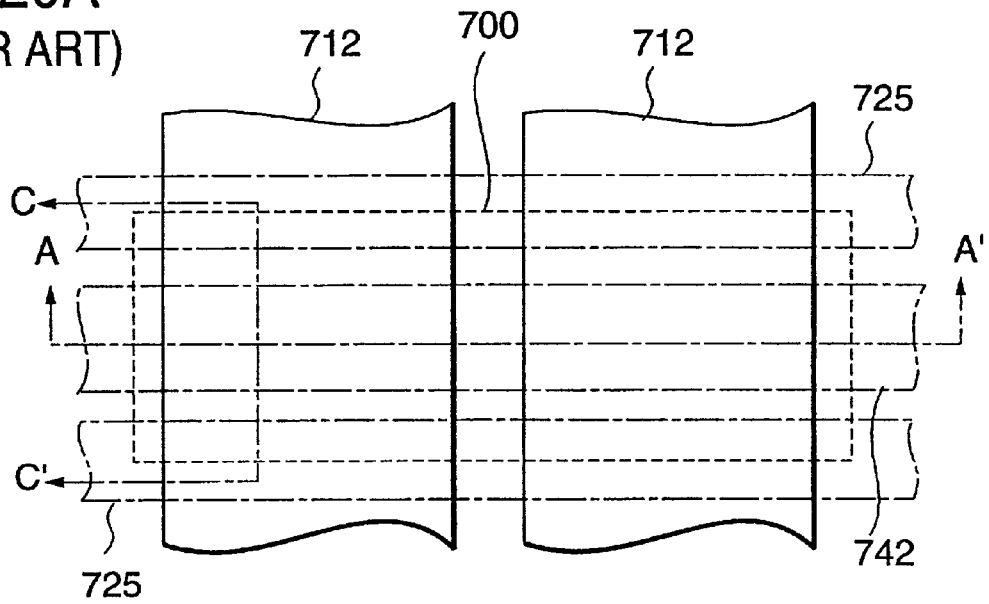
FIG.20A (PRIOR ART)
FIG. 20A is a plan view of discharge cells of a conventional PDP.
Figure 20B:
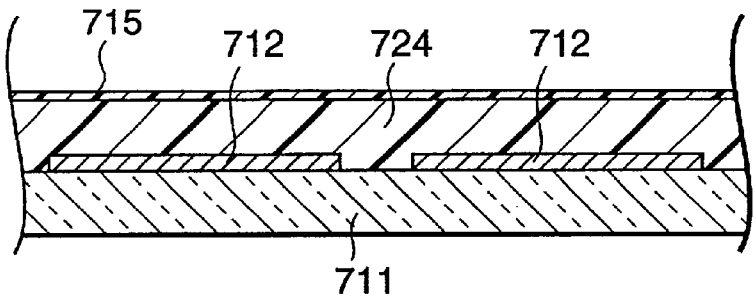
FIG.20B (PRIOR ART)
FIG. 20B is a cross section taken along a line A–A' in FIG. 20A.
Figure 20C:
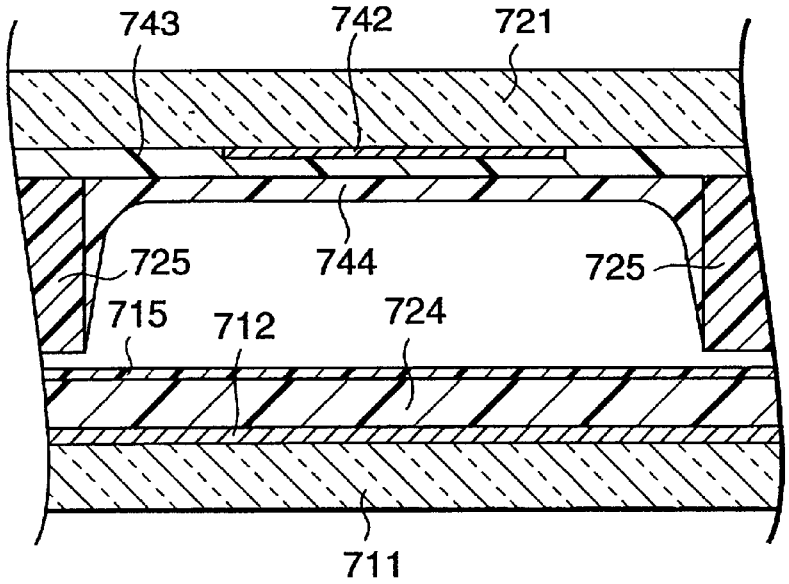
FIG.20C (PRIOR ART)
FIG. 20C is a cross section taken along a line C–C' in FIG. 20A.

FIGS. 20A, 20B and 20C show the conventional PDP fabricated for comparison purpose in order to prove the effect of the PDP according to the present invention.

In FIGS. 20A to 20C, electrode pairs of sustaining electrodes 712 for sustaining main discharge for generating ultraviolet ray for exciting the fluorescent member are formed on the first glass substrate 711 and the dielectric layer 724 is formed thereon. Furthermore, the protective film 15 such as a MgO film is formed on the dielectric layer 724.

On the other hand, on the second glass substrate 721, partition walls 725 are formed on the second glass substrate 721 such that display cells each of which becomes a unit for generating discharge are separated from each other and selection electrodes 742, which are orthogonal to the sustaining electrode pairs 712 for scanning the first glass substrate and controlling discharge of the display cell, are formed on the first glass substrate.

In order to allow the display cell to emit one of three primary color lights, a fluorescent material 744 capable of emitting desired one of R, G and B color lights is painted on an inner surface of each display cell, which is surrounded by the partition walls 725, and sintered.

Finally, the second glass substrate 721 is stuck together with the first glass substrate 711 to seal a discharge space formed therebetween. The color PDP is completed by evacuating the discharge spaces and filling the discharge spaces with a discharge gas, which is a gas mixture containing such as xenon for emitting ultraviolet lay for exciting the fluorescent materials.

In FIGS. 8A to 9B showing the second embodiment of the present invention, in which the discharge electrode pair has the double layer structure, the thickness of the lower dielectric layer 23 was changed from 10 $\mu$m to 50 $\mu$m and the thickness of the upper dielectric layer 24 was changed from 10 $\mu$m to 50 $\mu$m.

The characteristics of the PDP according to the first embodiment of the present invention, which has the lower dielectric layer 23 and the upper dielectric layer 24 having thickness thereof changed as mentioned above, was compared with the characteristics of the conventional PDP having the dielectric layer 724, which is formed on the sustaining electrodes 712 and has thickness, which is a sum of the thickness of the lower dielectric layer 23 and the upper dielectric layer 24 of the PDP according to the first embodiment of the present invention.

Figure 22:
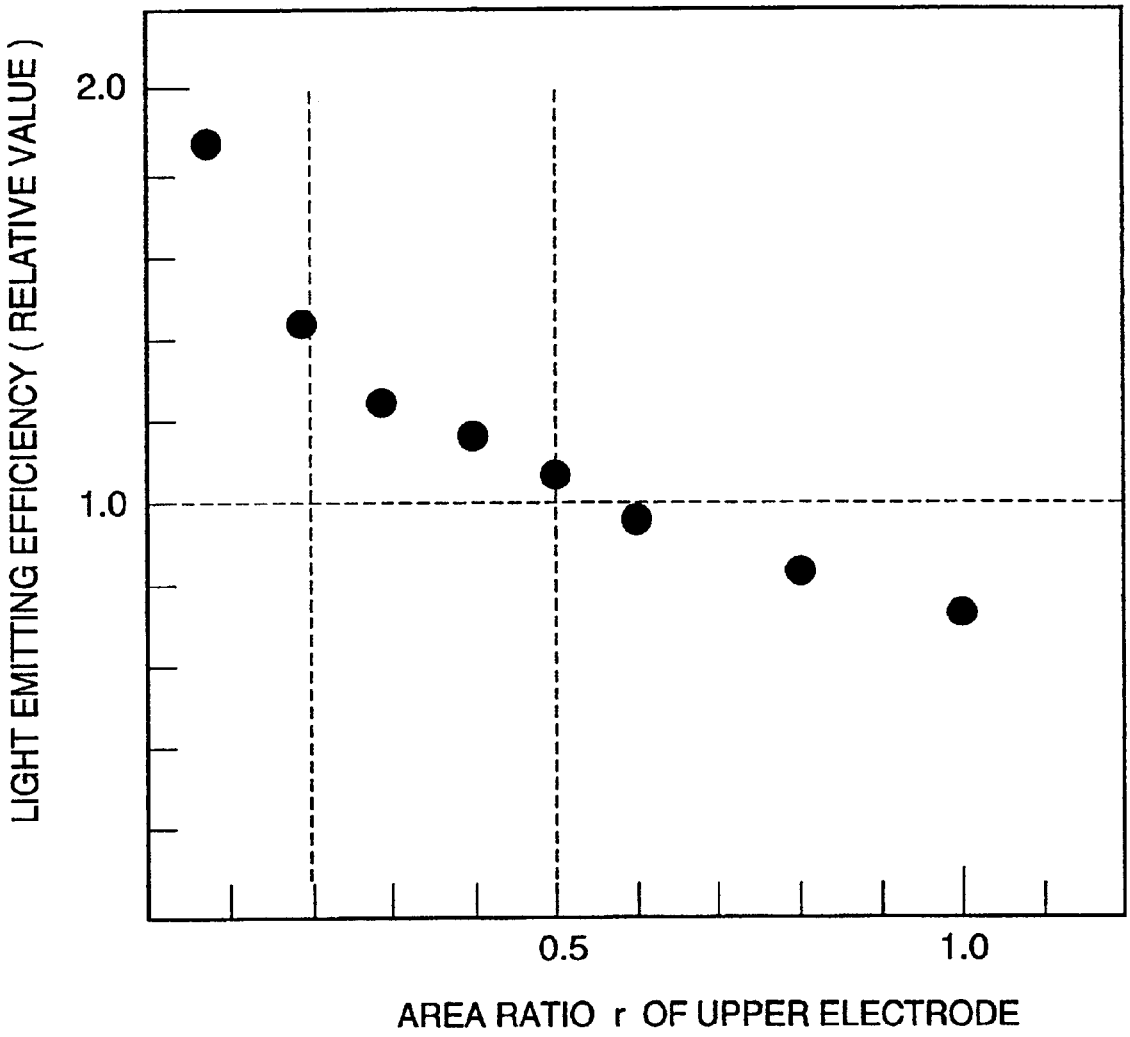
FIG. 22 is a graph showing an effect of the present invention.

FIG. 22 shows the light emitting efficiency of the PDP according to the present invention having the upper and lower dielectric layers having the same thickness was measured, while changing a ratio r of an area of the upper electrodes 122 to a total area of the lower electrodes 121 and the upper electrodes 122, with the light emitting efficiency of the conventional PDP having the dielectric layer whose thickness is equal to a sum of thickness of the lower and upper dielectric layers being 1.0.

Since the larger the ratio r of the upper electrodes means the thinner the dielectric layer, the light emitting efficiency of the PDP according to the present invention is low compared with that of the conventional PDP. However, when the area ratio of the upper electrodes is 0.5 or smaller, the light emitting efficiency of the present PDP becomes larger than that of the conventional PDP and it has been found that the light emitting efficiency of the present PDP is substantially improved when the area ratio is 0.2 or smaller.

Similar evaluations were made for the present PDP with using discharge gases having various constituents. According to the experiments conducted by the present inventors, it has been found that, when a partial pressure of Xe, Kr, Ar or $N_2$ is 100 hPa or higher, preferably, 300 hPa or higher, the improvement of light emitting efficiency of the present PDP becomes substantial.

On the other hand, when discharge gas containing Xe, Kr, Ar or $N_2$ at a partial pressure of 100 hPa or higher is used in the conventional PDP, the discharge start voltage is substantially increased and the sustenance of a stable display discharge becomes difficult since the discharge becomes unstable. In the present PDP, however, it is possible to restrict the increase of the discharge start voltage and to make the unstableness of discharge within practically acceptable ranges.

Although the second embodiment of the present invention has the lower dielectric layer 23 formed on a portion of the lower electrodes 121, it has been found that, in the first embodiment shown in FIGS. 6A to 7B in which the lower dielectric layer 13 is formed on the whole surface of the discharge cell and the two wiring layers for reducing resistance are connected together outside the display area, similar effect to that obtained by the second embodiment is obtained.

Furthermore, it has been found that the similar effect is obtained when the upper electrodes 122 are formed from an electrically conductive member of metal or metal particles having width of 100 $\mu$m or smaller, preferably, 50 $\mu$m or smaller.

It has been also found that, when the upper electrodes and the low resistance wiring are simultaneously formed by using the same material, the effect that the fabrication step is simplified is obtained in addition to the effect obtained in the second embodiment.

Figure 21A:
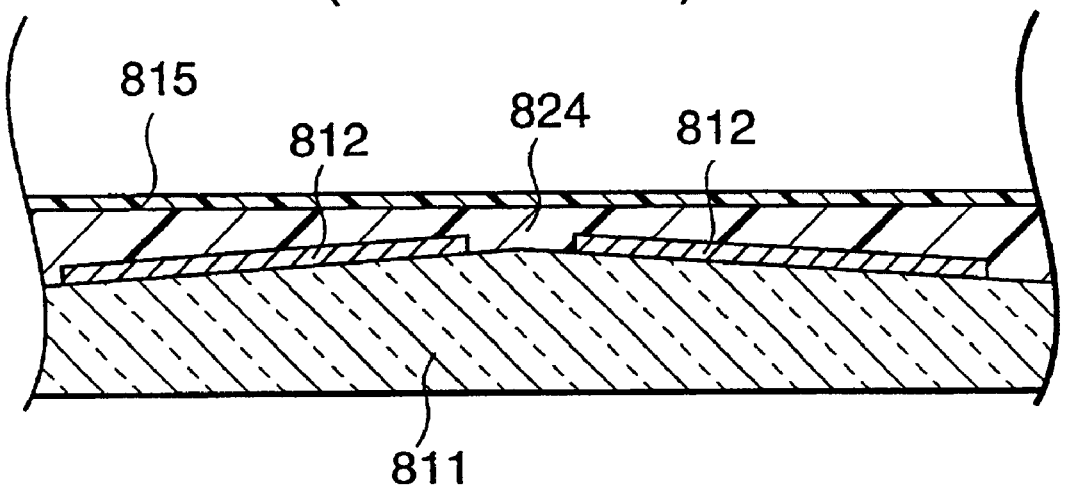
FIG.21A (PRIOR ART)
FIGS. 21A and 21B are cross sections of a discharge cell of another conventional PDP.
Figure 21B:
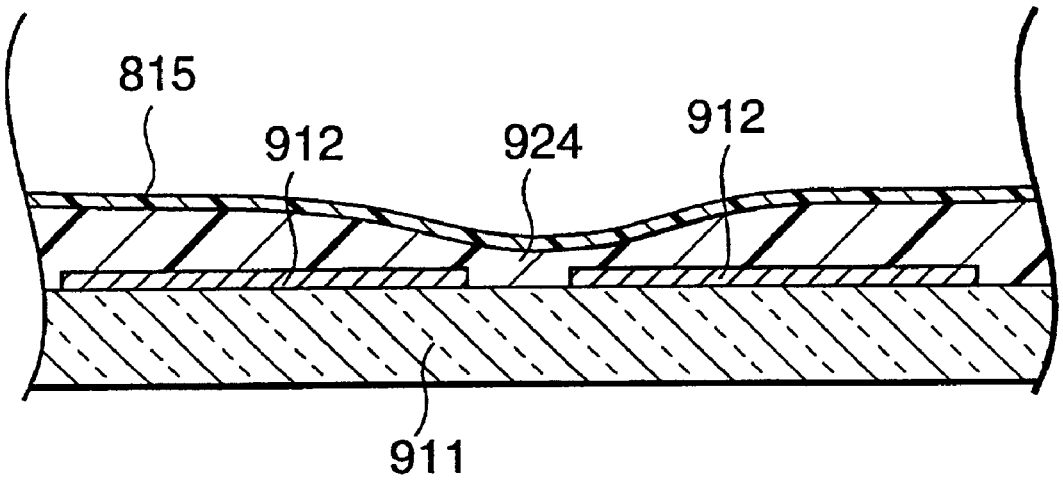
FIG.21B (PRIOR ART)

Moreover, though the thickness of the dielectric layer of the conventional PDP shown in FIGS. 21A and 21B is varied, it is possible to neglect the thickness variation of the dielectric layer in the present PDP since it is within the practically displayable range. This is because, according to the structure of the present invention, it is easily possible to uniformly form the upper electrodes having uniform width throughout the panel.

Although the present invention has been described with reference to the surface-discharge electrode for generating and sustaining the main discharge, it should be noted that the merit of the present invention is obtained for the electrode pair formed substantially on one and the same plane. For example, it is clear that the merit of the present invention can be obtained even if the height of plane on which the electrode pairs are formed is different, even if the electrode widths are different and/or even if the thin region of the dielectric layer is asymmetrical.

Finally, in the PDP according to the present invention, the light emitting efficiency is improved by forming the surface-discharge sustaining electrode pair by using not opposing electrode pairs in a single layer but opposing electrode pairs in a plurality of layers and making the dielectric layer on the electrodes in an upper layer thin. The present invention is not limited to the described embodiments and their modifications. It should be noted that the present invention covers other PDPs having structures in each of which the surface-discharge sustaining electrode pair includes a plurality of electrode pairs provided in different layers.

As described hereinbefore, the display quality of the PDP according to the present invention is improved by forming the surface-discharge sustaining electrode pair by opposing electrodes arranged in a plurality of different layers, making the dielectric layer on the opposing electrodes in an uppermost layer thin to restrict the discharge sustaining voltage to a low value and to make the light emitting efficiency high. Therefore, it is possible to improve the display quality of the PDP.

What is claimed is:

1. A plasma display panel comprising: a first substrate having a plurality of electrode pairs covered by a dielectric layer, at least one of electrodes constituting each said electrode pair being separated in a thickness direction of said dielectric layer to form a lower electrode and an upper electrode, said lower and upper electrodes having a connecting wire to make each of said lower and upper electrodes pair equipotential; a second substrate arranged in an opposing relation to said first substrate with a gap; and discharge gas filling said gap between said first substrate and said second substrate.

2. A plasma display panel as claimed in claim 1, wherein said upper electrode includes electrodes provided in a plurality of different layers in the thickness direction of said dielectric layer.

3. A plasma display panel as claimed in claim 2, wherein each of said electrodes of each said electrode pair includes said lower electrode and said upper electrode, one of said upper electrodes includes opposing electrodes provided in a plurality of different layers and the other opposing upper electrode includes opposing electrodes provided in the same number of different layers and corresponding ones of said electrode layers of said opposing upper electrodes are in the same position in the thickness direction of said dielectric layer.

4. A plasma display panel as claimed in claim 3, wherein said one of said opposing upper electrodes and said the other of said opposing upper electrodes are formed symmetrically about a center of a first sustain gap between one of said opposing lower electrodes of each said electrode pair and the other lower electrode.

5. A plasma display panel as claimed in claim 4, wherein a second sustain gap is provided between one of said upper electrodes and the other upper electrode, which are mutually opposing with a gap therebetween, which gap is the smallest among gaps between said upper electrodes of said electrode pair, and said second sustain gap is substantially coincident with said first sustain gap.

6. A plasma display panel as claimed in claim 4, wherein a second sustain gap is provided between one of said upper electrodes and the other upper electrode, which are mutually opposing with a gap therebetween, which gap is the smallest among gaps between said upper electrodes of said electrode pair, and one of said first sustain gap and said second sustain gap is within the other region.

7. A plasma display panel as claimed in claim 3, wherein a center of said first sustain gap is deviated from a center of said second sustain gap.

8. A plasma display panel as claimed in claim 1, wherein each of said electrodes of each said electrode pair includes said lower electrode and said upper electrode and at least one divided electrode having a potential equal to the potential of one of said upper electrodes is provided on a side of said one upper electrode corresponding to at least one of said lower electrodes in a plane, which is the same as a plane of said one upper electrode, remote from said other lower electrode.

9. A plasma display panel as claimed in claim 1, wherein a width of said upper electrode is a half of a width of said lower electrode or less.

10. A plasma display panel as claimed in claim 1, wherein a width of said upper electrode is one fifth a width of said lower electrode or less.

11. A plasma display panel as claimed in claim 1, further comprising a lower resistance wiring which extends externally to internally for leading said upper electrode together with said lower electrode.

12. A plasma display panel as claimed in claim 11, further comprising partition walls formed on said second substrate extending in parallel in a direction orthogonal to said electrode pairs formed on said first substrate, wherein said first substrate includes discharge cell regions uniformly partitioned by said partition walls and regions for separating the plurality of said electrode pairs and said connecting wiring is formed in a region of each said discharge cell region except said second sustain gap between said upper electrodes corresponding to said electrode pair.

13. A plasma display panel as claimed in claim 11, wherein said low resistance wiring is formed either on said substrate on which said lower electrodes are formed or in a position of said upper electrode in a thickness direction of said dielectric layer.

14. A plasma display panel as claimed in claim 1, wherein said upper electrode is formed in a single layer and said dielectric layer includes a first dielectric layer deposited on said substrate and underlying said upper electrode and a second dielectric layer covering said substrate having said first dielectric layer.

15. A plasma display panel as claimed in claim 14, wherein said upper electrodes constitute a single layer upper electrode pair corresponding to said electrode pair and said dielectric layer is formed below said second sustain gap between said upper electrode pair such that said dielectric layer contains said second sustain gap.

16. A plasma display panel as claimed in claim 1, wherein said discharge gas contains at least one of xenon, krypton, argon and nitrogen as exciting gas for generating ultraviolet light for exciting a fluorescent member and a partial pressure of the exciting gas is 100 hPa or higher when said exciting gas contains one of xenon, krypton, argon and nitrogen.

17. A plasma display panel comprising: a lower electrode pair connecting a first substrate; a first dielectric layer covering at least a portion of the lower electrode pair and contacting at least a portion of the first substrate; an upper electrode pair contacting an upper part of the first dielectric layer and being separated in a thickness direction of the first dielectric layer from the lower electrode pair; the lower and upper electrode pairs having a connecting wiring to make each of said lower and upper electrode pair equipotential; a second substrate arranged in an opposing relation to the first substrate with a gap; and discharge gas filing the gap between the first substrate and the second substrate.

18. The plasma display panel of claim 17, wherein, the first dielectric layer covers only a portion of the lower electrode pair.

19. A plasma display panel comprising:

a lower electrode pair contacting a first substrate;

a first dielectric layer covering at least a portion of the lower electrode pair and contacting at least a portion of the first substrate;

an upper electrode pair contacting an upper part of the first dielectric layer and being separated in a thickness direction of the first dielectric layer from the lower electrode pair;

the lower and upper electrode pairs being connected electrically to each other;

the lower and upper electrode pairs being equipotential;

a second substrate arranged in an opposing relation to the first substrate with a gap;

discharge gas filling the gap between the first substrate and the second substrate;

a second dielectric layer contacting an upper surface of the first dielectric layer; and a further-upper pair of electrodes contacting an upper part of the second dielectric layer and being separated in a thickness direction of the second dielectric layer from the upper electrode pair;

the lower, upper, and further-upper electrode pairs being connected electrically each other;

the lower, upper, and further upper electrode pairs being equipotential.

20. The plasma display panel of claim 19, wherein, the first dielectric layer covers only a portion of the lower electrode pair;

the second dielectric layer contacts only a portion of the upper surface of the first dielectric layer; and the second dielectric layer is free of contact with the upper electrode pair.

* * * * *